US011751741B2

(12) United States Patent
Lee et al.

(10) Patent No.: US 11,751,741 B2
(45) Date of Patent: Sep. 12, 2023

(54) VACUUM CLEANER

(71) Applicant: LG ELECTRONICS INC., Seoul (KR)

(72) Inventors: Kookhaeng Lee, Seoul (KR); Jungwan Ryu, Seoul (KR); Moo Hyun Ko, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 140 days.

(21) Appl. No.: 17/379,410

(22) Filed: Jul. 19, 2021

(65) Prior Publication Data

US 2022/0022710 A1 Jan. 27, 2022

(30) Foreign Application Priority Data

Jul. 23, 2020 (KR) ..... 10-2020-0091888

(51) Int. Cl.
*A47L 9/24* (2006.01)
*A47L 5/24* (2006.01)
*A47L 9/06* (2006.01)

(52) U.S. Cl.
CPC ..... *A47L 9/242* (2013.01); *A47L 5/24* (2013.01); *A47L 9/06* (2013.01)

(58) Field of Classification Search
CPC ..... A47L 9/242; A47L 19/06; A47L 19/02; A47L 19/0477; A47L 19/244; A47L 19/0673; A47L 19/066; A47L 19/248; A47L 5/24; A47L 5/225; A47L 5/30
See application file for complete search history.

(56) References Cited

U.S. PATENT DOCUMENTS 6,237,188 B1 * 5/2001 Takemoto ..... A47L 5/14 15/387
6,904,640 B2 * 6/2005 Jin ..... A47L 9/242 15/377
9,027,203 B2 * 5/2015 Conrad ..... A47L 5/28 15/421
2010/0139030 A1 * 6/2010 Yoo ..... A47L 5/30 15/328

(Continued)

FOREIGN PATENT DOCUMENTS

KR 10-1841455 3/2018

*Primary Examiner* — Anne M Kozak
*Assistant Examiner* — Christopher Soto
(74) *Attorney, Agent, or Firm* — KED & ASSOCIATES, LLP

(57) ABSTRACT

A vacuum cleaner includes a cleaner body, a connection pipe including a first catching groove, and a suction nozzle. The suction nozzle includes a connection neck, a nozzle housing rotatably coupled to the connection neck, a first catching body rotatably coupled to the connection neck, and a first elastic body. The first catching body includes a first catching protrusion portion which is caught by the first catching groove. The suction nozzle includes a pressing portion and a first lever. The first lever includes a first end portion in contact with the pressing portion, and a second end portion configured to press the first catching body. According to the disclosed vacuum cleaner, the fastening between the suction nozzle and the connection pipe may be maintained or released according to the relative angle between the suction nozzle and the connection pipe.

20 Claims, 21 Drawing Sheets

(56) References Cited

U.S. PATENT DOCUMENTS

2011/0219580 A1* 9/2011 Conrad ..... A47L 5/28
15/410
2015/0297050 A1* 10/2015 Marsh ..... A47L 9/242
15/347

* cited by examiner

VACUUM CLEANER

CROSS-REFERENCE TO RELATED APPLICATION

This application claims priority under 35 U.S.C. § 119 to Korean Application No. 10-2020-0091888 filed on Jul. 23, 2020, whose entire disclosure is hereby incorporated by reference.

BACKGROUND

1. Field

The present disclosure relates to a vacuum cleaner including a suction nozzle and a connection pipe coupled to the suction nozzle and, more particularly, to a vacuum cleaner including a suction nozzle and a connection pipe that can be separated from each other.

2. Background

A vacuum cleaner refers to a device configured to generate an air pressure difference such that dust and the like are drawn into the vacuum cleaner. A vacuum cleaner may include a cleaner body and a suction nozzle. The cleaner body may have a motor provided therein, and the motor may be configured to rotate such that suction power is generated. The suction power generated inside the cleaner body may be transferred to the suction nozzle such that external dust and the like are suctioned into the vacuum cleaner through the suction nozzle.

Vacuum cleaners may be classified, according to the configuration thereof, into canister types, upright types, and handy/stick types. A canister-type cleaner includes a cleaner body having wheels, and a suction nozzle provided separately from the cleaner body and connected to the cleaner body through a hose. An upright-type cleaner includes a cleaner body and a suction nozzle together coupled to a mop.

A handy/stick-type cleaner includes a cleaner body and a handle provided thereon such that the user can use the same while holding the cleaner body portion. A handy-type cleaner has a cleaner body and a suction nozzle positioned relatively close to each other, and a stick-type cleaner has a cleaner body and a suction nozzle positioned relatively far from each other. A robot cleaner, which is another type of vacuum cleaner, is configured to use various sensors so as to autonomously move while suctioning dust and the like.

A vacuum cleaner may include multiple suction nozzles. The respective suction nozzles may come in different types. For example, one suction nozzle may have a suction port elongated leftwards/rightwards so as to be appropriate for common floor cleaning. Another suction nozzle may have a narrow-width suction port so as to be appropriate for cleaning narrow gaps. Still another suction port may have a brush coupled thereto so as to be able to brush off dust.

In connection with vacuum cleaners, Korean Patent Registration No. 1841455 B1 (registered Mar. 19, 2018) discloses a vacuum cleaner having multiple different nozzles that can be replaced and used. In addition, Korean Patent Registration No. 1841455 discloses a cradle on which idle suction nozzles can be cradled and stored such that the user is not inconvenienced by storage of suction nozzles, and loss of the suction nozzles can also be prevented.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein:

FIG. 17A and FIG. 17B illustrate partial configurations in a cross-sectional form.

DETAILED DESCRIPTION

Figure 1:
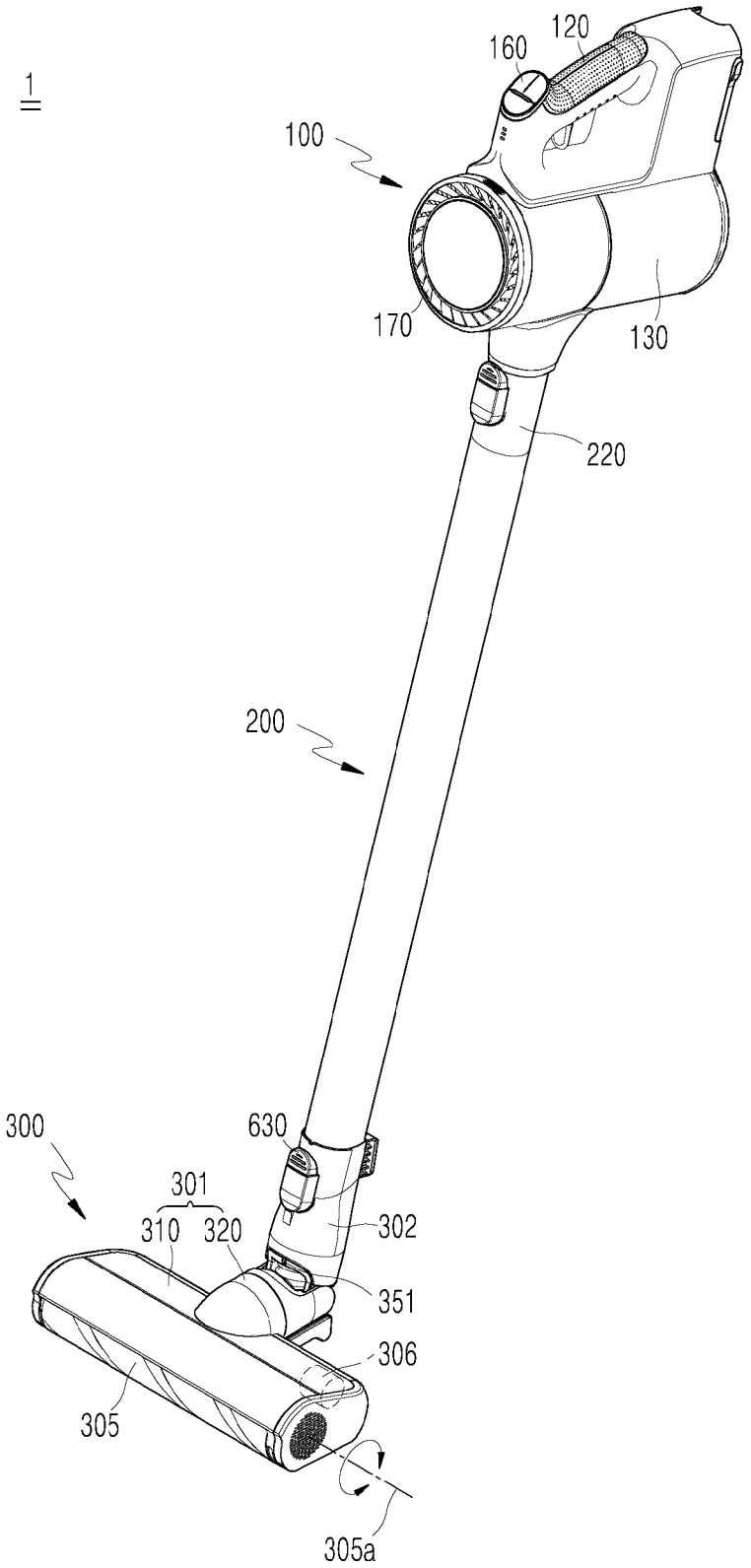
FIG. 1 is a perspective view illustrating a vacuum cleaner according to an embodiment of the present disclosure.

Hereinafter, in order to describe the present disclosure in more detail, embodiments according to the present disclosure will be described in more detail with respect to the accompanying drawings. Like reference numerals refer to like elements throughout the detailed description.

Figure 2:
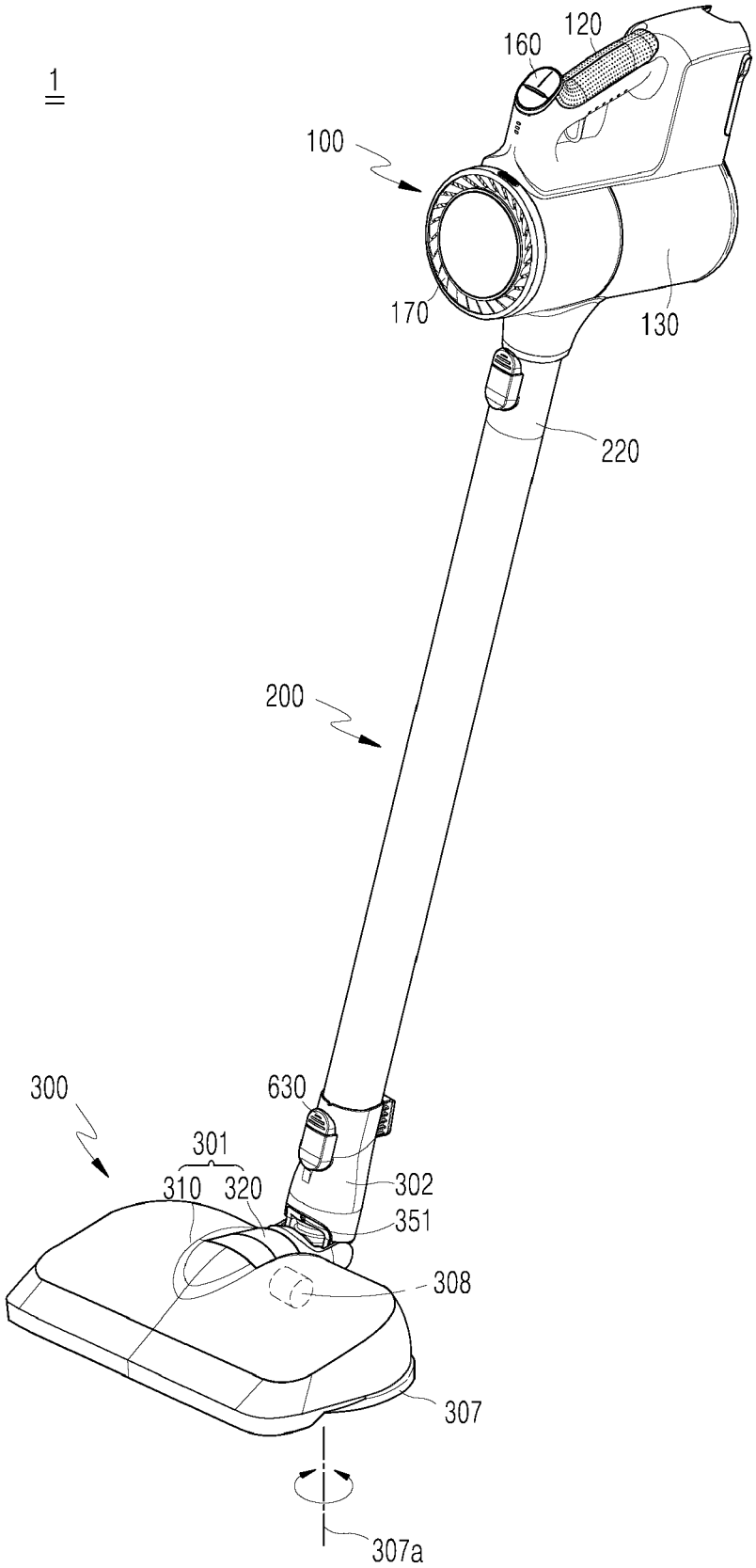
FIG. 2 is a perspective view illustrating a vacuum cleaner according to an embodiment different from that of FIG. 1.
Figure 3:
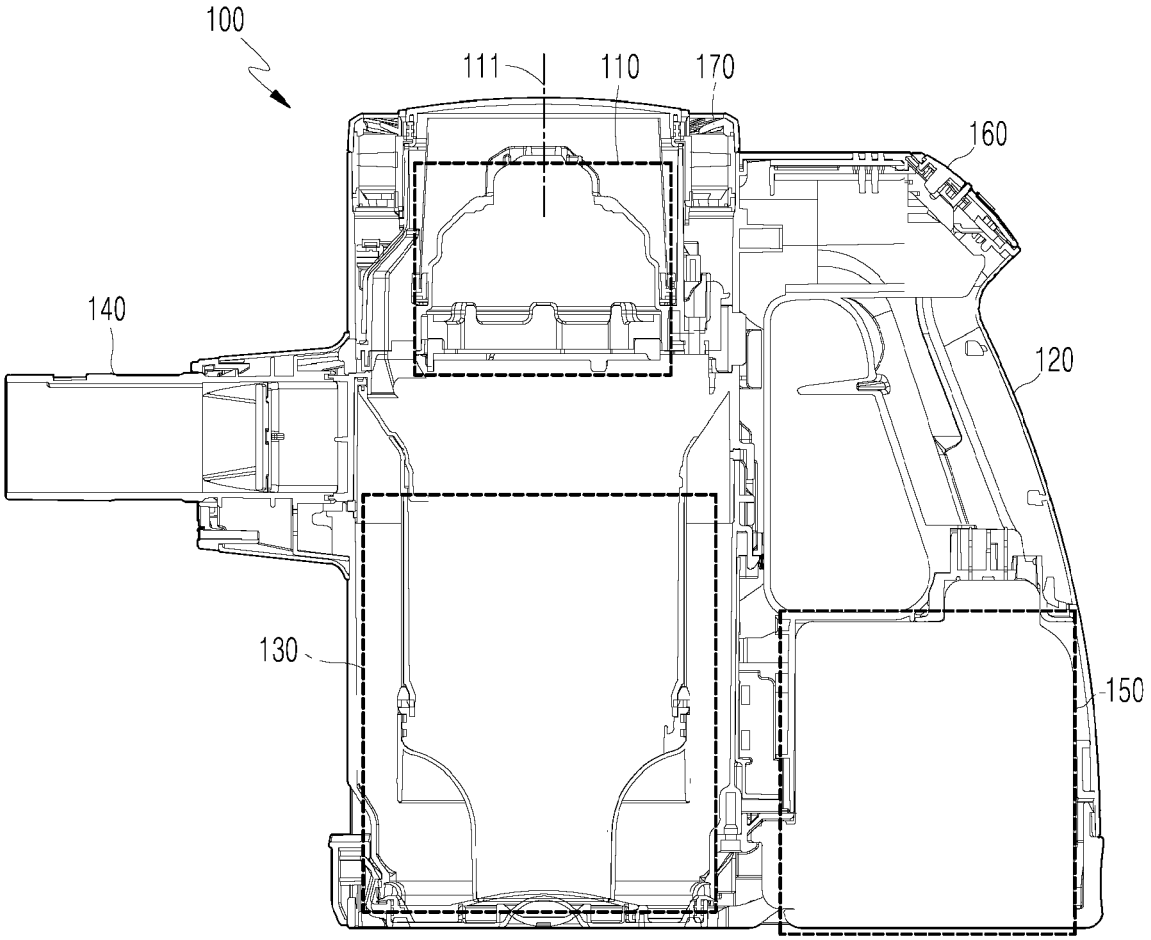
FIG. 3 is a cross-sectional view illustrating a cleaner body, and FIG. 3 schematically illustrates positions of components disposed in the cleaner body.
Figure 4:
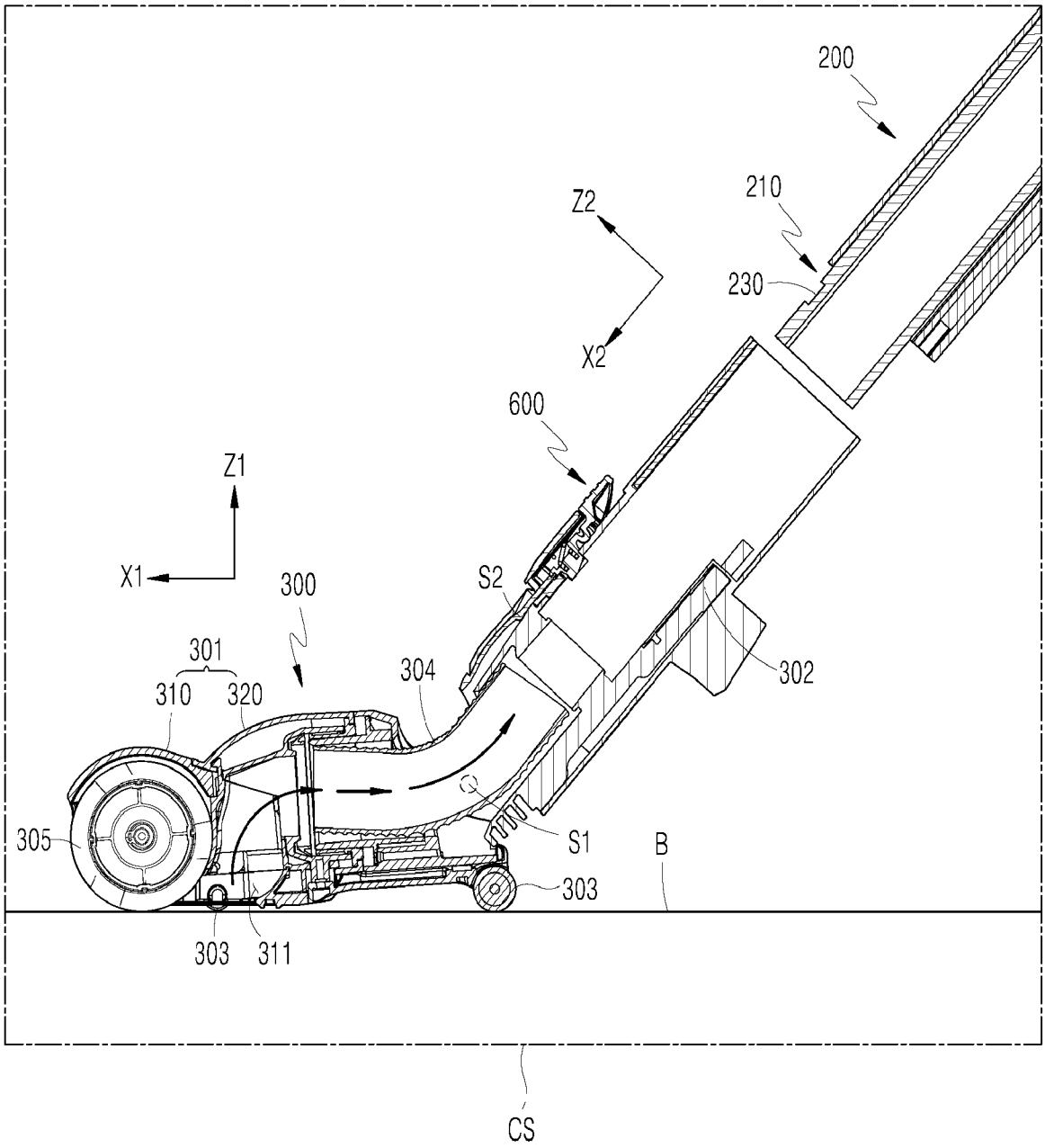
FIG. 4 is a cross-sectional view illustrating a vacuum cleaner according to an embodiment of the present disclosure.

FIG. 1 is a perspective view illustrating a vacuum cleaner 1 according to an embodiment of the present disclosure. FIG. 2 is a perspective view illustrating a vacuum cleaner 1 according to an embodiment different from that of FIG. 1. FIG. 3 is a cross-sectional view illustrating a cleaner body 100. FIG. 3 schematically illustrates positions of components disposed in the cleaner body 100. FIG. 4 is a cross-sectional view illustrating a vacuum cleaner 1 according to an embodiment of the present disclosure.

A vacuum cleaner 1 is configured to suction external air and/or foreign substances such as dust and hair. The vacuum cleaner 1 includes a cleaner body 100, a connection pipe 200, and a suction nozzle (also referred to herein as a suction head or removable nozzle) 300. External air and the like are first introduced through the suction nozzle 300 and then moved to the cleaner body 100 through the connection pipe 200.

The cleaner body 100 is configured to generate a suction force. To this end, the cleaner body 100 includes a motor (a first motor 110). Motors described in an embodiment of the present disclosure, including the first motor 110, may include a BLDC motor, a step motor, and the like.

A fan is coupled to the first motor 110 of the cleaner body 100, and accordingly, a flow of air is generated when the first motor 110 is rotated. The first motor 110 and the fan coupled to the first motor 110 are rotated about a rotation axis 111 in the cleaner body 100, so that a pressure difference may be generated between the inside and the outside of the cleaner body 100, and accordingly, a suction force may be generated by the cleaner body 100. The suction nozzle 300 includes a first suction port 311, which is a hole through which air and/or foreign substances are introduced (see FIG. 4).

The connection pipe 200 is configured to connect the cleaner body 100 and the suction nozzle 300. The connection pipe 200 has a pipe or tube shape, and forms a passage through which the external air introduced through the first suction port 311 moves toward the cleaner body 100.

The connection pipe 200 may be made of a relatively hard material so as not to be bent or deformed unintentionally. The connection pipe 200 may be made of plastic or metal, or may be made by including plastic and metal.

The connection pipe 200 includes a first connection portion (or inlet) 210 and a second connection portion (or outlet) 220. The first connection portion 210 may form an inlet of the connection pipe 200 through which external air is introduced into the connection pipe 200, and the second connection portion 220 may form an outlet of the connection pipe 200 through which the air inside the connection pipe 200 is discharged toward the cleaner body 100. The first connection portion 210 and the second connection portion 220 may form opposite end portions of the connection pipe 200.

In an embodiment, the cleaner body 100 may be fixedly coupled to the second connection portion 220 of the connection pipe 200. That is, the cleaner body 100 and the connection pipe 200 may be fixed to each other without moving separately from each other. In this case, the vacuum cleaner 1 may be configured in the form of a "stick-type cleaner".

In another embodiment, a cleaner body may be coupled to a second connection portion 220 of a connection pipe 200 by means of a separate means. For example, a separate hose, which is flexibly bent, may be coupled between the connection pipe and the cleaner body. That is, a vacuum cleaner may be configured such that the cleaner body and the connection pipe can move separately. In this case, the vacuum cleaner may be configured in the form of a "canister-type cleaner".

Hereinafter, as shown in FIG. 1 or FIG. 2, the cleaner body 100 is described based on a form in which the cleaner body 100 is fixed to the second connection portion 220 of the connection pipe 200. In an embodiment, the cleaner body 100 may include a handle grip 120, a dust container 130, a body suction port 140, and a battery 150.

The handle grip 120 is disposed on one side of the cleaner body 100. The handle grip 120 is shaped such that a user can stably hold the handle grip using his/her hand. The handle grip 120 may be disposed on the side opposite to the body suction port 140 (the opposite side of the body suction port 140). If the body suction port 140 is disposed on the front side of the cleaner body 100, the handle grip 120 may be disposed on the rear side of the cleaner body 100. In the cleaner body 100, an operation button 160 capable of operating the vacuum cleaner 1 may be disposed at a position adjacent to the handle grip 120.

The dust container 130 is a container configured to collect foreign substances such as dust separated from air inside the cleaner body 100. The foreign substances such as dust introduced into the cleaner body 100 may be separated from the air by a cyclonic manner. In addition, the air separated from the foreign substances in the cleaner body 100 may be discharged to the outside of the cleaner body 100 through a separate discharge port 170.

The dust container 130 may be detachably coupled to the cleaner body 100. The dust container 130 may be made transparent so that foreign substances collected therein can be visually identified from the outside.

The battery 150 is configured to supply power to each component of the vacuum cleaner 1. The battery 150 may supply power to the first motor 110 of the cleaner body 100.

The body suction port 140 forms an inlet of the cleaner body 100 through which air, dust, and the like are introduced into the cleaner body 100. The body suction port 140 may be configured to protrude outward from the cleaner body 100. The second connection portion 220 of the connection pipe 200 may be fixedly coupled to the body suction port 140.

Figure 5:
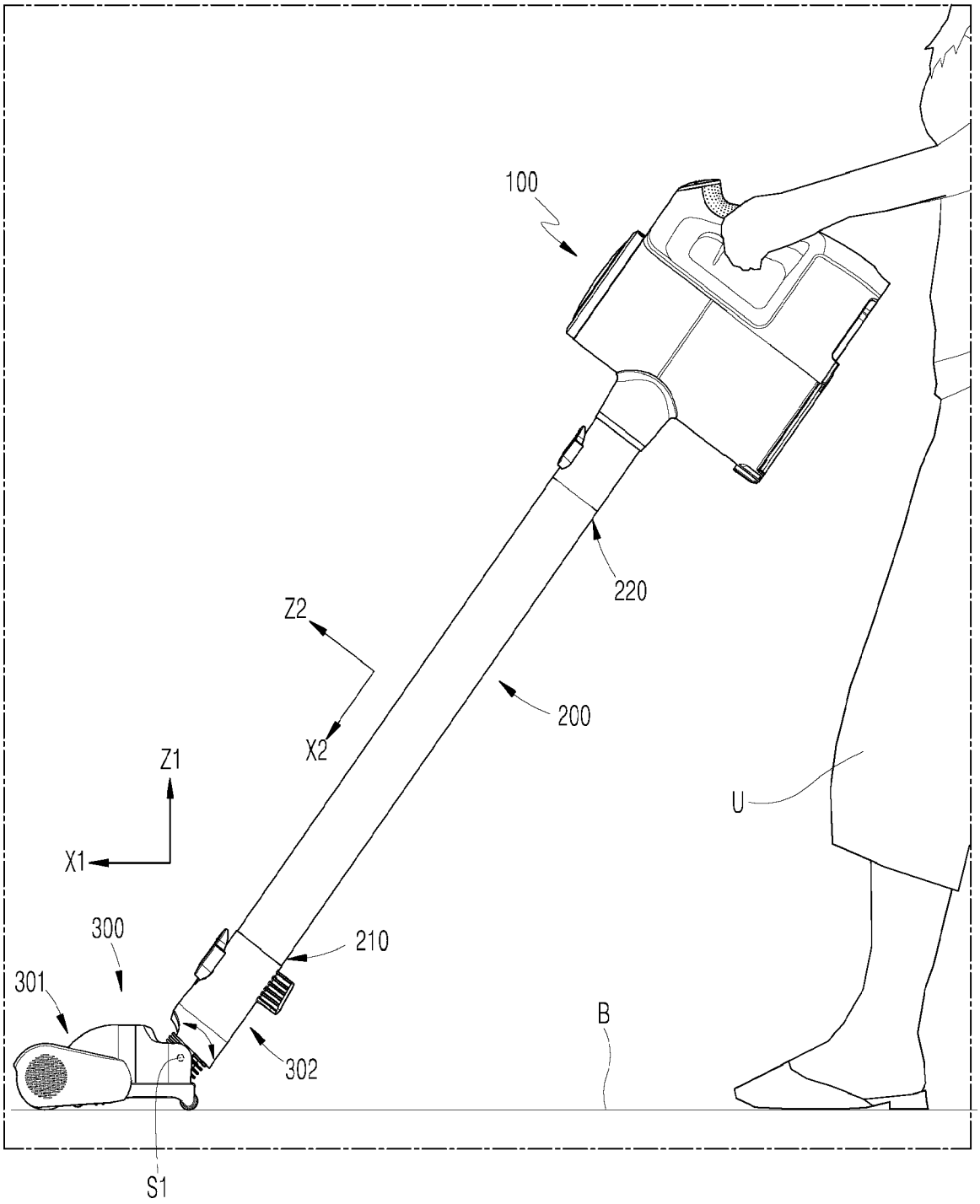
FIG. 5 illustrates a use state of a vacuum cleaner.
Figure 6:
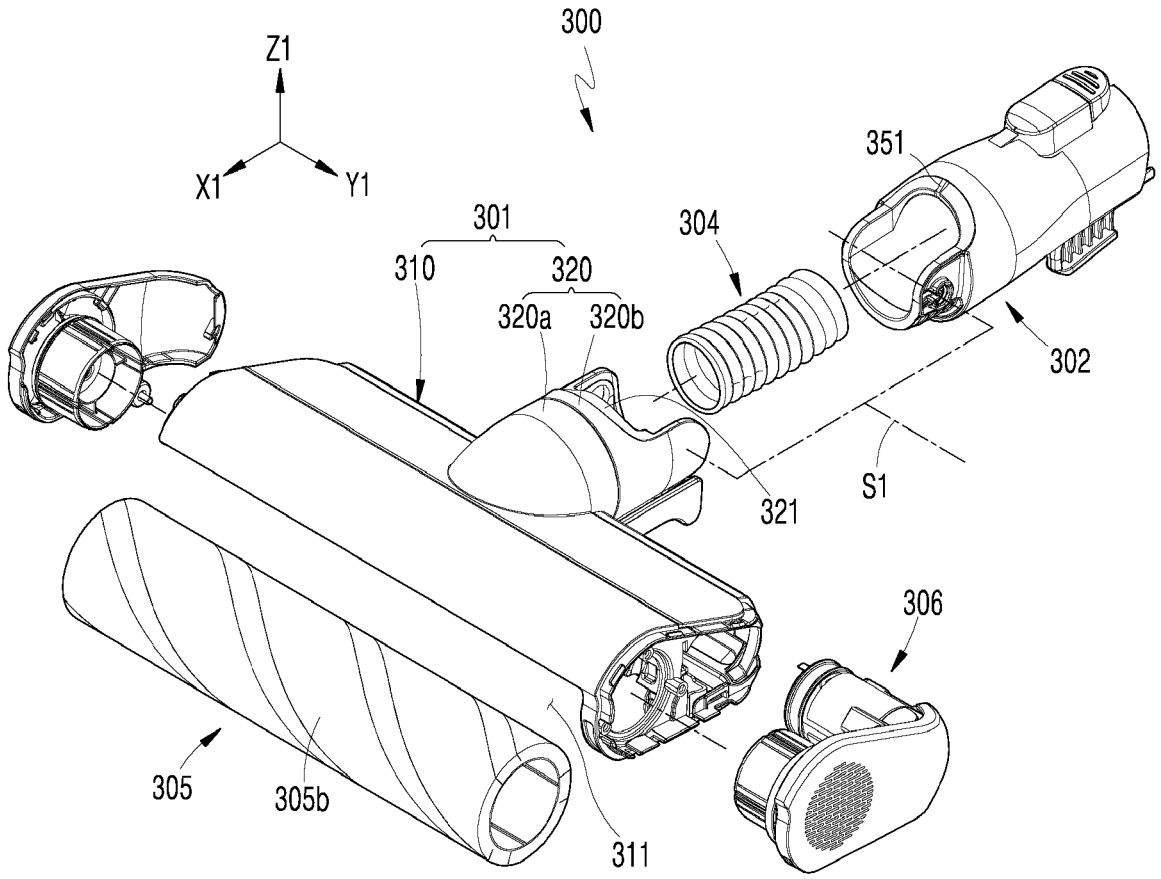
FIG. 6 is an exploded perspective view illustrating a suction nozzle of a vacuum cleaner.

FIG. 5 illustrates a use state of the vacuum cleaner 1. FIG. 6 is an exploded perspective view illustrating the suction nozzle 300 of the vacuum cleaner 1.

X1, Y1, and Z1, which are directions described in an embodiment of the present disclosure, are directions orthogonal to each other. X1 may be a frontward direction of the vacuum cleaner 1, Y1 may be a leftward direction of the vacuum cleaner 1, and Z1 may be an upward direction of the vacuum cleaner 1. X1 and Y1 may be directions parallel to a floor surface B, and Z1 may be a direction perpendicular to the floor surface B.

A user U can use the vacuum cleaner 1 while holding the cleaner body 100, and in this case, the connection pipe 200 may be placed slantingly downwards in front of the user U, and the suction nozzle 300 may be positioned on the floor surface B in front of the user U. The use of the vacuum cleaner 1 in this state may be a natural use state of the vacuum cleaner 1.

In an embodiment, the suction nozzle 300 may have a structure suitable for suctioning dust and the like while placed on the floor surface B in front of the user U. To this end, the suction nozzle 300 itself may be configured such that frontward and rearward directions are distinguished from each other and upward and downward directions are distinguished from each other.

Assuming that the suction nozzle 300 is placed on the flat floor surface B along a horizontal direction, the frontward direction X1 and the leftward direction Y1 of the suction nozzle 300 may be directions parallel to the horizontal direction, respectively, and the upward direction Z1 of the suction nozzle 300 may be a direction parallel to a vertical direction. The suction nozzle 300 may be formed in a bilaterally symmetrical shape.

As described above, the suction nozzle 300 includes the first suction port 311. The first suction port 311 may be the first inlet through which air and foreign substances are introduced into the vacuum cleaner 1, and the suction nozzle 300 may have various structures within the range including the first suction port 311.

In an embodiment, the suction nozzle 300 may include a nozzle housing 301 and a connection neck 302. The nozzle housing 301 may be configured to be placed on the floor and moved along the floor surface B. In this case, the first suction port 311 may be disposed on the bottom surface of the nozzle housing 301. For smooth movement of the nozzle housing 301 placed on the floor, a plurality of wheels (casters 303) may be disposed on the bottom surface of the nozzle housing 301.

The nozzle housing 301 may include a nozzle head portion (or nozzle head) 310 and a nozzle neck portion (or nozzle neck) 320. The nozzle head portion 310 may form a front part of the nozzle housing 301, and the nozzle neck portion 320 may form a rear part of the nozzle head portion 310. The first suction port 311 may be disposed on the bottom surface of the nozzle head portion 310.

The nozzle neck portion 320 has a tube shape, and extends from the rear of the nozzle head portion 310 in a rearward direction. In the nozzle housing 301, the nozzle neck portion 320 is a part coupled to the connection neck 302, and the nozzle neck portion 320 may be rotatably coupled to the connection neck 302.

The connection neck 302 is a part coupled to the connection pipe 200 in the suction nozzle 300. The connection neck 302 is detachably coupled to the first connection portion 210. The connection neck 302 may have a tube shape, and the inside of the connection neck 302 is configured to communicate with the first suction port 311 and to communicate with the inside of the connection pipe 200.

The foreign substances introduced into the first suction port 311 in the suction nozzle 300 may move toward the connection pipe 200 through the inside of the nozzle neck portion 320 and the inside of the connection neck 302. A separate corrugated tube 304 may be inserted into the nozzle housing 301 (particularly, the nozzle neck portion 320) and the connection neck 302, and when the corrugated tube 304 is provided, the foreign substances (dust and the like) introduced into the first suction port 311 move toward the connection pipe 200 through the corrugated tube 304. The connection neck 302 may form a rear part of the suction nozzle 300, and may be disposed behind the nozzle housing 301.

As described above, the nozzle housing 301 (the nozzle neck portion 320) and the connection neck 302 are rotatably coupled to each other. The nozzle housing 301 (the nozzle neck portion 320) and the connection neck 302 are coupled to each other so as to be rotatable about a first rotation shaft S1. The first rotation shaft S1 may be parallel to the floor surface B.

In an embodiment, the suction nozzle 300 may include a rotary cleaner (or roller) 305. The rotary cleaner 305 generally has a roller shape, and is coupled to the nozzle housing 301 (the nozzle head portion 310) so as to be rotatable about a central axis 305*a* thereof. The rotary cleaner 305 may be coupled to the bottom surface of the nozzle housing 301 (the nozzle head portion 310) in front of the first suction port 311 (see FIG. 1, etc.).

The rotary cleaner 305 may have the same shape as an agitator of a vacuum cleaner. A motor (a second motor 306) may be disposed inside the suction nozzle 300 for rotation of the rotary cleaner 305.

In an embodiment, an outer circumferential surface layer 305*b* including a brush and/or cotton flannel may be disposed on the outer circumferential surface of the rotary cleaner 305. The outer circumferential surface layer 305*b* of the rotary cleaner 305 may be disposed to be in contact with the floor surface B or close to the floor surface B, and as the rotary cleaner 305 rotates, dust on the floor may be swept or suctioned toward the first suction port 311.

In another embodiment, the suction nozzle 300 may include a rag 307 (see FIG. 2). The rag 307 may be made flat and coupled to the bottom surface of the nozzle housing 301 (the nozzle head portion 310), and coupled to the nozzle housing 301 (the nozzle head portion 310) so as to be rotatable about a rotation axis 307*a* perpendicular to the floor surface B or substantially perpendicular to the floor surface B. Two rags 307 may be provided, and the two rags 307 may be rotated in opposite directions. A motor (a third motor 308) may be disposed inside the suction nozzle 300 for rotation of the rags 307.

Figure 7A:
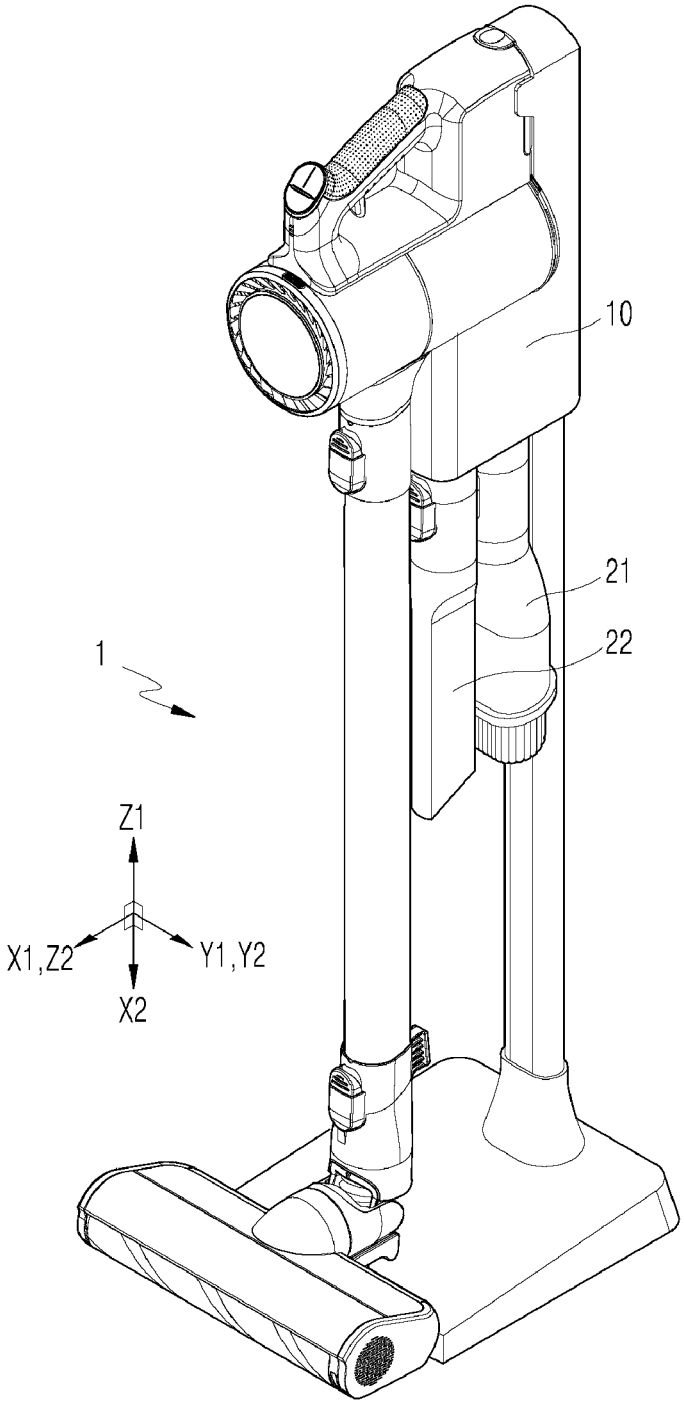
FIG. 7A is a perspective view illustrating a state in which a vacuum cleaner is mounted on a cradle.
Figure 7B:
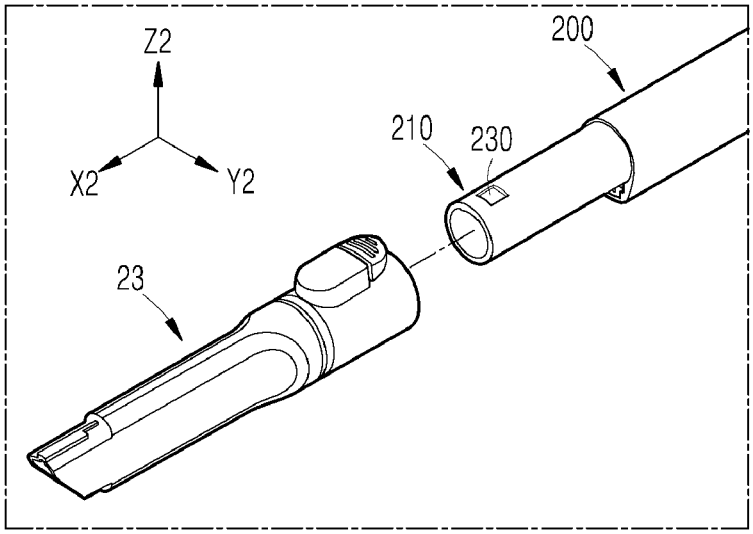
FIG. 7B is a view for explaining attachment/detachment of a nozzle to/from a first connection portion of a connection pipe.

Additional description of the suction nozzle 300 is described below. FIG. 7A is a perspective view illustrating a state in which the vacuum cleaner 1 is mounted on a cradle 10, and FIG. 7B is a view for explaining attachment/detachment of a nozzle 23 to/from the first connection portion 210 of the connection pipe 200.

As described above, the connection pipe 200 includes the first connection portion 210 and the second connection portion 220. The direction from the first connection portion 210 toward the second connection portion 220 may be the longitudinal direction of the connection pipe 200, and the direction from the second connection portion 220 toward the first connection portion 210 may be the longitudinal direction of the connection pipe 200.

In an embodiment of the present disclosure, the direction from the second connection portion 220 toward the first connection portion 210 is described as a first direction X2. Further, as described above, the nozzle housing 301 and the connection neck 302 are coupled to each other so as to be rotatable about the first rotation shaft S1, and in this case, the first rotation shaft S1 may be parallel to the floor surface B. In the present disclosure, the direction parallel to the first rotation shaft S1 is described as a second direction Y2. The first direction X2 and the second direction Y2 may be orthogonal to each other.

When the suction nozzle 300 (the nozzle housing 301) is placed on a flat floor in a horizontal direction and used, the second direction Y2 may be a direction parallel to the horizontal direction and the first direction X2 may be a predetermined direction orthogonal to the second direction Y2.

The direction orthogonal to the first direction X2 and the second direction Y2 is determined as a third direction Z2. In particular, when the connection pipe 200 is laid down parallel to the flat floor in the horizontal direction, the third direction Z2 may be a vertical direction, and when the connection pipe 200 is stood vertically upright, the third direction Z2 may be a forward direction.

In an embodiment, the connection pipe may have a shape in which the longitudinal direction thereof extends along a curved line. In another embodiment, the connection pipe 200 may have a form in which the longitudinal direction thereof extends along a straight line. That is, the connection pipe 200 may be parallel to the first direction X2, and a central axis of the connection pipe 200 may be parallel to the first direction X2. With respect to the first direction X2, the first connection portion 210 forms a part of the front of the connection pipe 200, and the second connection portion 220 forms a part of the rear of the connection pipe 200.

The connection pipe 200 may have a cross-section having a constant shape along the longitudinal direction (the first direction X2) thereof, or may have a cross-section having a varied shape along the longitudinal direction thereof. The connection pipe 200 may be configured to have a circular tube shape or a polygonal tube shape.

The vacuum cleaner 1 according to an embodiment of the present disclosure may be stored while mounted on a separate cradle 10. When the vacuum cleaner 1 is mounted on the cradle 10, the battery 150 of the vacuum cleaner 1 may be charged through the cradle 10.

As described above, the connection neck 302 of the suction nozzle 300 is coupled to the first connection portion 210 of the connection pipe 200 or is separated therefrom. In a state in which the suction nozzle 300 is separated from the connection pipe 200, nozzles 21, 22, and 23, other than the suction nozzle 300, may be coupled to the first connection portion 210 of the connection pipe 200.

Figure 8A:
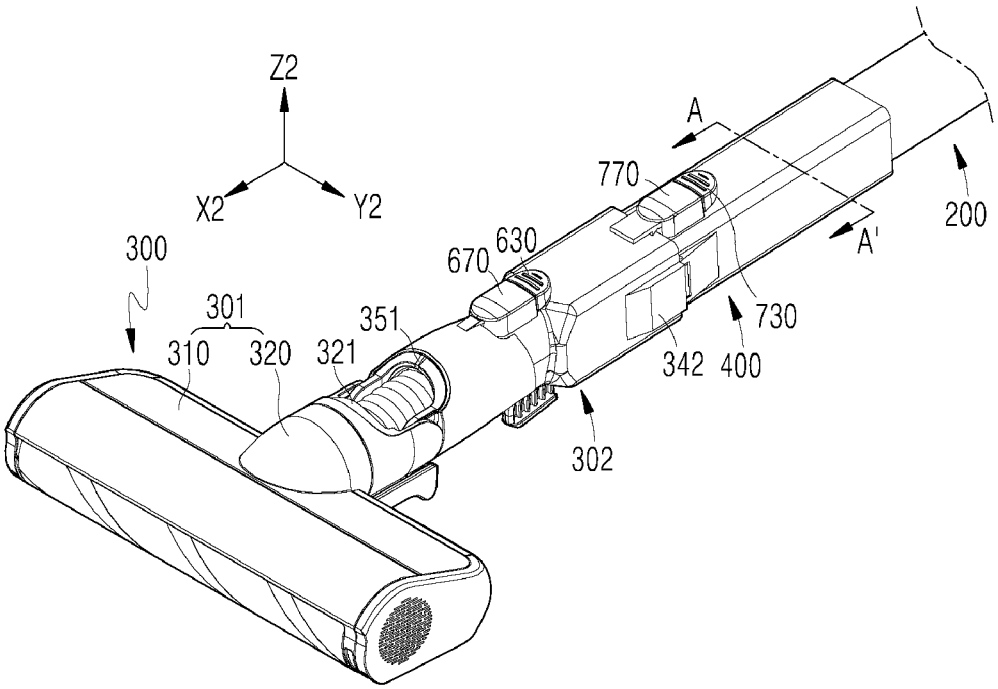
FIG. 8A is a perspective view illustrating a part of a vacuum cleaner according to an embodiment of the present disclosure.
Figure 8B:
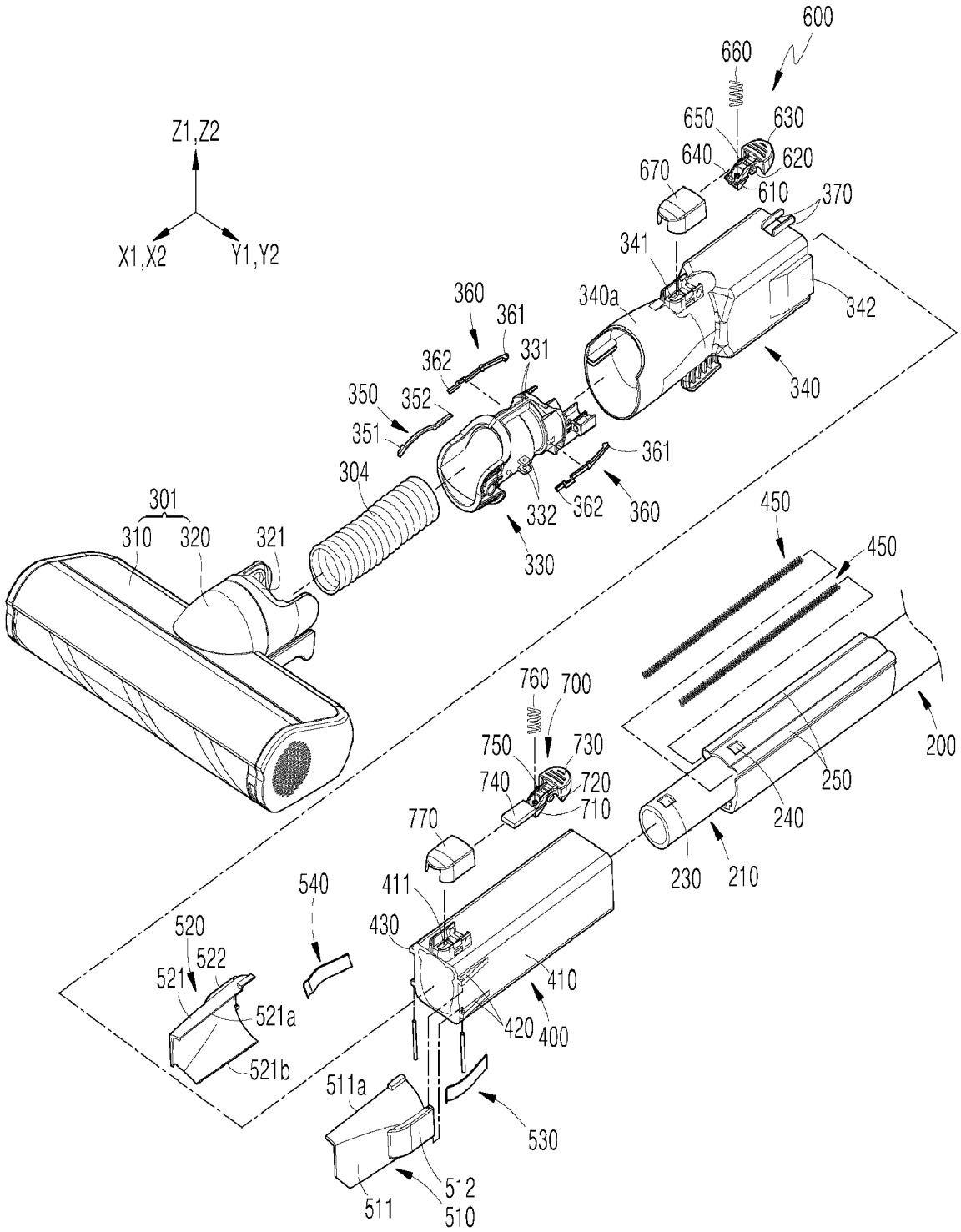
FIG. 8B is an exploded perspective view illustrating the vacuum cleaner of FIG. 8A.
Figure 9:
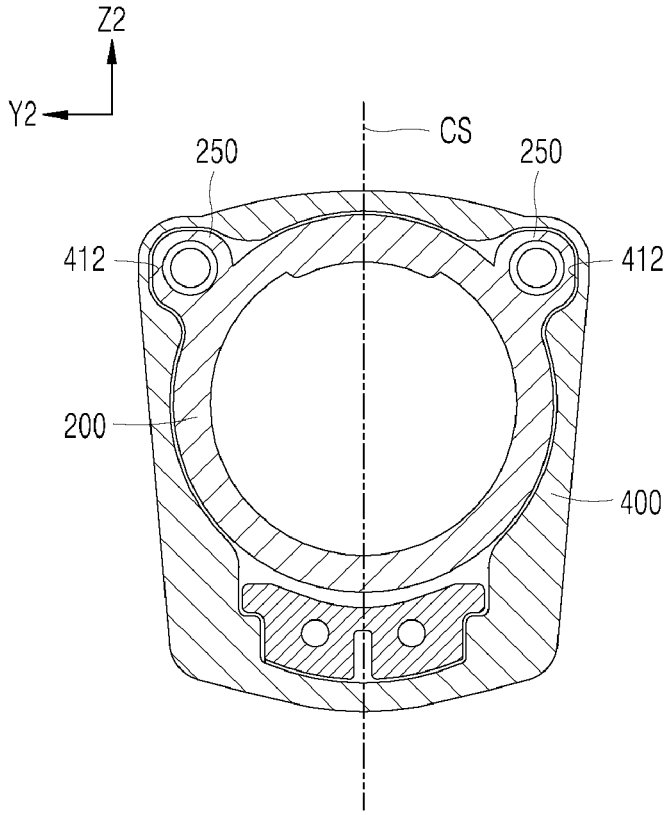
FIG. 9 is a cross-sectional view taken along line A-A' of FIG. 8A.
Figure 10A:
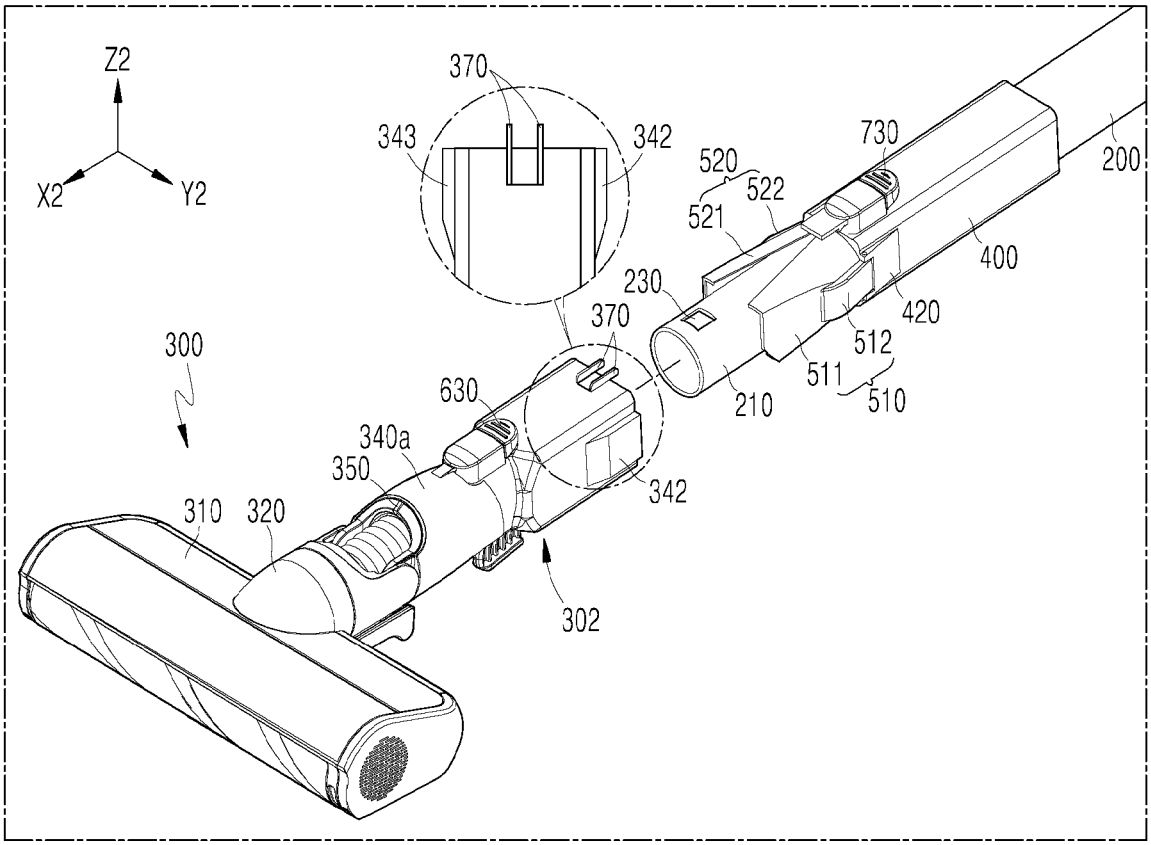
FIG. 10A illustrates a suction nozzle and a connection pipe which are separated from the vacuum cleaner of FIG. 8A.
Figure 10B:
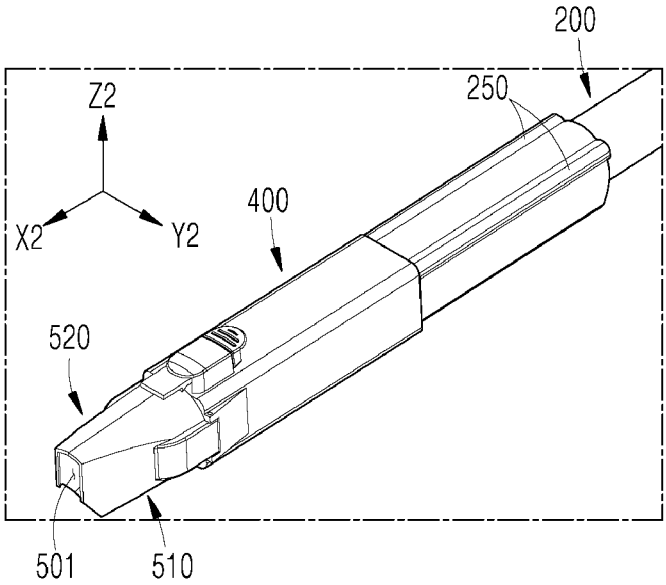
FIG. 10B illustrates a state in which a movable body, a first rotating body, and a second rotating body in FIG. 10A have moved.
Figure 11A:
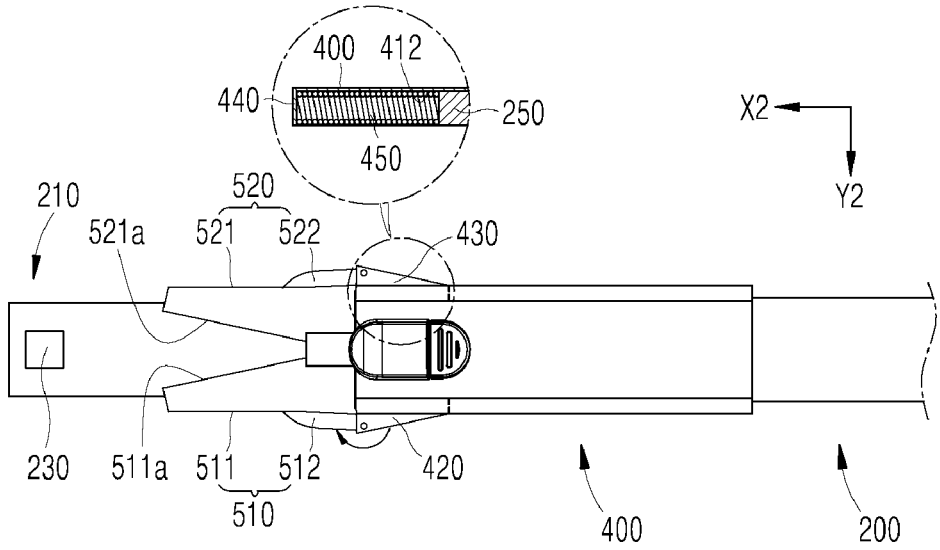
FIG. 11A is a plan view illustrating a partial configuration of a vacuum cleaner.
Figure 11B:
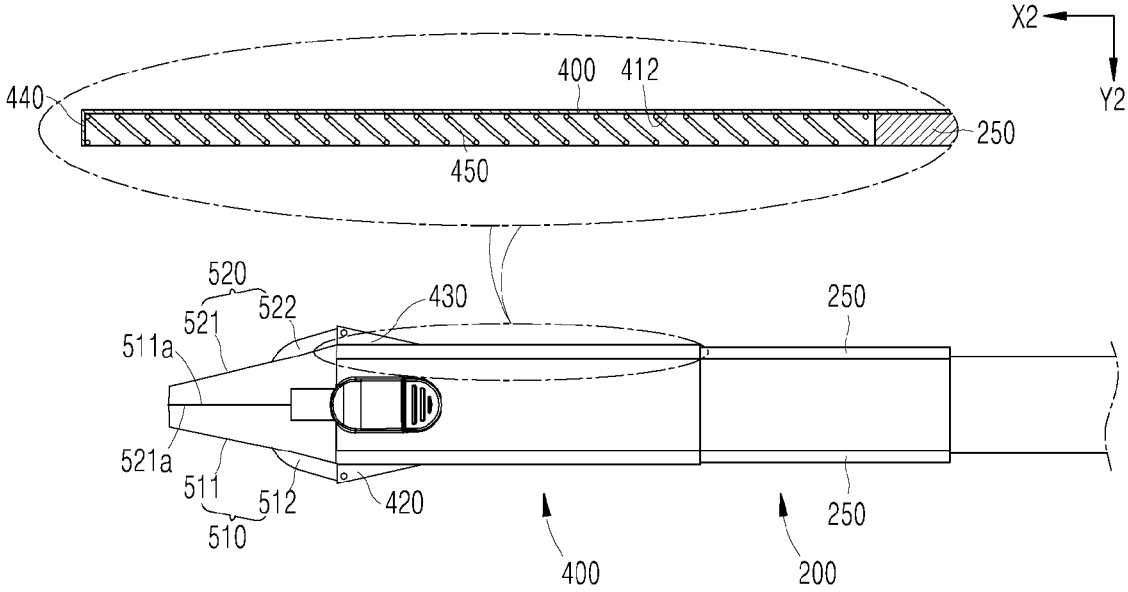
FIG. 11B is a plan view illustrating a state in which a movable body, a first rotating body, and a second rotating body FIG. 11A have moved.
Figure 12:
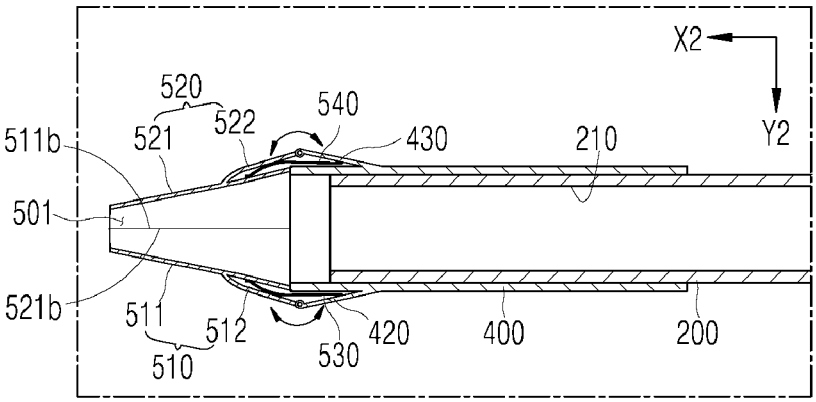
FIG. 12 is a longitudinal cross-sectional view of the vacuum cleaner of FIG. 11B.

FIG. 8A is a perspective view illustrating a part of the vacuum cleaner 1 according to an embodiment of the present disclosure, and FIG. 8B is an exploded perspective view illustrating the vacuum cleaner 1 of FIG. 8A. FIG. 9 is a cross-sectional view taken along line A-A' of FIG. 8A. FIG. 10A illustrates the suction nozzle 300 and the connection pipe 200 separated from the vacuum cleaner 1 of FIG. 8A, and FIG. 10B illustrates a state in which a movable body 400, a first rotating body 510, and a second rotating body 520 in FIG. 10A have moved. FIG. 11A is a plan view illustrating a partial configuration of the vacuum cleaner 1, and FIG. 11B is a plan view illustrating a state in which the movable body 400, the first rotating body 510, and the second rotating body 520 in FIG. 11A have moved. FIG. 12 is a longitudinal cross-sectional view of the vacuum cleaner of FIG. 11B.

The vacuum cleaner 1 includes the movable body (or sliding nozzle) 400, the first rotating body (or first cover) 510, and the second rotating body (or second cover) 520. The movable body 400 is movably coupled to the connection pipe 200. The movable body 400 may be coupled to the connection pipe 200 so as to be movable along the longitudinal direction of the connection pipe 200. The movable body 400 may be coupled to the connection pipe 200 so as to be movable along the first direction X2.

The movable body 400 is configured to move (reciprocate) between a first position and a second position along the first direction X2. With respect to the first direction X2, the first position is a relatively rear position and the second position is a relatively front position.

When the movable body 400 is in the first position (see FIGS. 10A and 11A), front ends of the first rotating body 510 and the second rotating body 520 are positioned behind the first connection portion 210 with respect to the first direction X2. When the movable body 400 is in the first position, the first connection portion 210 is exposed, and accordingly, the suction nozzle 300 (the connection neck 302) may be coupled to the first connection portion 210 of the connection pipe 200.

When the suction nozzle 300 (the connection neck 302) is separated from the first connection portion 210 of the connection pipe 200, the movable body 400 may move from the first position to the second position. When the movable body 400 is in the second position (see FIGS. 10B and 11B), the front ends of the first rotating body 510 and the second rotating body 520 are positioned in front of the first connection portion 210 with respect to the first direction X2, and as the first rotating body 510 and the second rotating body 520 are rotated (rotated in opposite directions to each other) relative to the movable body 400, the first rotating body 510 and the second rotating body 520 may form a second suction port 501.

In an embodiment, the movable body 400 may be coupled to the outer circumferential surface of the connection pipe 200 to move along the first direction X2. The movable body 400 has a tube shape so as to surround a part of the connection pipe 200. The longitudinal direction of the movable body 400 may be parallel to the first direction X2, and the movable body 400 may have open front and rear sides in the first direction X2.

The movable body 400 may include a central tube 410, a first fixing bracket 420, and a second fixing bracket 430. The central tube 410 has a central axis parallel to the first direction X2. The central tube 410 may have a substantially constant inner diameter along the first direction X2. The central tube 410 may be symmetrical with respect to a central surface CS orthogonal to the second direction Y2. That is, the central tube 410 may be formed in a bilaterally symmetrical shape.

The first fixing bracket 420 protrudes outward from the front part of the central tube 410 with respect to the first direction X2. The second fixing bracket 430 protrudes outward from the front part of the central tube 410 with respect to the first direction X2. However, the second fixing bracket 430 may be symmetrical with the first fixing bracket 420 with respect to the central surface CS. In an embodiment, when the first fixing bracket 420 is disposed on the left side of the central tube 410, the second fixing bracket 430 may be disposed on the right side of the central tube 410.

In a state in which the movable body 400 is coupled to the connection pipe 200, the inner surface of the movable body 400 (the inner surface of the central tube 410) may be stably in close contact with the outer surface of the connection pipe 200 so that there is no play (movement in a direction orthogonal to the first direction X2) of the movable body 400 relative to the connection pipe 200.

In addition, in a state in which the movable body 400 is coupled to the connection pipe 200, the movable body 400 and the connection pipe 200 may be coupled to each other so that there is no rotation of the movable body 400 (rotation of the movable body 400 about the central axis of the connection pipe 200) relative to the connection pipe 200.

In an embodiment, the vacuum cleaner 1 may include a guide groove 412, a guide rail 250, and a coil spring 450. The guide groove 412 may be configured to have a shape of a concave groove on the inner surface of the movable body 400 (the central tube 410). In addition, the guide groove 412 may be configured to extend parallel to the first direction X2 on the inner surface of the movable body 400. That is, the guide groove 412 may extend in the first direction X2.

The guide groove 412 extends to the end of a rear end of the movable body 400 with respect to the first direction X2. That is, when the movable body 400 is viewed from the rear in the first direction X2, a rear end of the guide groove 412 is exposed.

The guide groove 412 does not extend to the end of a front end of the movable body 400 with respect to the first direction X2. That is, when the movable body 400 is viewed from the front in the first direction X2, a front end of the guide groove 412 is not exposed. A blocking wall 440 is disposed at the front end of the guide groove 412 with respect to the first direction X2.

The guide rail 250 may be configured to protrude from the outer surface of the connection pipe 200. In addition, the guide rail 250 may be configured to extend in parallel to the first direction X2 on the outer surface of the connection pipe 200. That is, the guide rail 250 may extend in the first direction X2. The guide rail 250 is inserted into the guide groove 412, and relative movement occurs between the guide rail 250 and the guide groove 412 in the first direction X2 or in the direction opposite to the first direction X2.

A transverse cross-section of the guide rail 250 and a transverse cross-section of the guide groove 412 may be configured to have the same or a corresponding shape and size at the part where the guide rail 250 and the guide groove 412 are in close contact with each other (see FIG. 9). The guide rail 250 may be positioned behind the first connection portion 210 with respect to the first direction X2. That is, with respect to the first direction X2, the front end of the guide rail 250 is positioned behind the front end of the connection pipe 200 (a front end of the first connection portion 210).

When the movable body 400 is coupled to the connection pipe 200, at least a part of the guide rail 250 is inserted into the guide groove 412. When the movable body 400 is positioned as far to the rear as possible relative to the connection pipe 200 with respect to the first direction X2 (when the movable body is in the first position), the part of the guide rail 250 that is inserted into the guide groove 412 is at a maximum extent, and when the movable body 400 is positioned as far to the front as possible relative to the connection pipe 200 with respect to the first direction X2 (when the movable body is in the second position), the part of the guide rail 250 that is inserted into the guide groove 412 is at a minimum extent.

The coil spring 450 is configured to elastically support the movable body 400 relative to the connection pipe 200 such that the movable body 400 moves in the first direction X2 relative to the connection pipe 200. The coil spring 450 may be configured to have the same shape as a conventional coil spring, and when an external force acts thereon, the coil spring 450 may store elastic energy while being compressed, and when the external force is removed, the coil spring 450 may be elastically deformed while being stretched again. The coil spring 450 is elongated in the first direction X2.

The coil spring 450 is inserted into the guide groove 412 in front of the guide rail 250 with respect to the first direction X2, and has one end supported by the movable body 400 and the other end supported by the connection pipe 200. In particular, the coil spring 450 may have one end supported by the blocking wall 440 of the movable body 400 and the other end supported by the front end of the guide rail 250 of the connection pipe 200.

In an embodiment, when the movable body 400 is positioned as far to the rear as possible with respect to the connection pipe 200 with respect to the first direction X2 (when the movable body is in the first position), the degree of compression of the coil spring 450 is in a maximum state (the state in which the elastic energy stored in the coil spring 450 is at a maximum), and when the movable body 400 is positioned as far to the front as possible with respect to the connection pipe 200 with respect to the first direction X2 (when the movable body is in the second position), the degree of compression of the coil spring 450 is in a minimum state (the state in which the elastic energy stored in the coil spring 450 is at a minimum).

In an embodiment, a plurality of guide grooves 412, a plurality of guide rails 250, and a plurality of coil springs 450 are provided. For example, two guide grooves 412, two guide rails 250, and two coil springs 450 may be provided.

The first rotating body 510 and the second rotating body 520 are rotatably coupled to the movable body 400. The first rotating body 510 and the second rotating body 520 may be positioned opposite to each other with respect to the movable body 400, and may be symmetrical to each other. A rotation shaft of the first rotating body 510 and a rotation shaft of the second rotating body 520 may be parallel to the third direction Z2.

The first rotating body 510 and the second rotating body 520 are coupled to the front part of the movable body 400 with respect to the first direction X2. The first rotating body 510 and the second rotating body 520 may be coupled to the front end of the movable body 400 with respect to the first direction X2.

While the first rotating body 510 and the second rotating body 520 are rotated with respect to the movable body 400 in opposite directions to each other, the front ends of the first rotating body 510 and the second rotating body 520 may be rotated away from each other, and may also be rotated such that the respective front ends of the first rotating body 510 and the second rotating body 520 are close to each other.

In a state in which the connection pipe 200 is coupled to the connection neck 302, the movable body 400 is in the first position and the front end of the first rotating body 510 and the front end of the second rotating body 520 are positioned behind the first connection portion 210 with respect to the first direction X2. Since the connection pipe 200 is positioned between the first rotating body 510 and the second rotating body 520 when the movable body 400 is in the first position, by the connection pipe 200, the first rotating body 510 and the second rotating body 520 are in a state in which the front ends thereof are spread apart from each other.

When the suction nozzle 300 is separated from the connection pipe 200 (the first connection portion 210), the first rotating body 510 and the second rotating body 520 together with the movable body 400 move forward in the first direction X2. When the movable body 400 is in the second position, the front end of the first rotating body 510 and the front end of the second rotating body 520 are positioned in front of the first connection portion 210 with respect to the first direction X2. When the movable body 400 is in the second position, with respect to the first direction X2, the front end of the movable body 400 and the front end of the connection pipe 200 (the first connection portion 210) may be placed at the same position or close to each other.

When the movable body 400 is in the second position, the first connection portion 210 of the movable body 400 is not positioned between the first rotating body 510 and the second rotating body 520, and accordingly, the first rotating body 510 and the second rotating body 520 may be rotated in opposite directions such that the respective front ends are close to each other. Accordingly, the first rotating body 510 and the second rotating body 520 may form the second suction port 501 communicating with the inside of the connection pipe 200.

When the first rotating body 510 and the second rotating body 520 form the second suction port 501, the first rotating body 510 and the second rotating body 520 are combined with each other to have a shape of a single tube. That is, the second suction port 501, which is an open hole, is disposed at the front end of the tube formed by the combination of the first rotating body 510 and the second rotating body 520, and the connection pipe 200 (the first connection portion 210) is coupled to the rear of the tube formed by the combination of the first rotating body 510 and the second rotating body 520.

The second suction port 501 forms an inlet through which foreign substances are introduced into the connection pipe 200 and the cleaner body 100, and within such a range, the first rotating body 510 and the second rotating body 520 may be configured to have various shapes.

For the configuration of the second suction port 501, each of the first rotating body 510 and the second rotating body 520 may be configured to generally have a half tube shape. That is, the first rotating body 510 and the second rotating body 520 may form a completed tube in a state in which the first rotating body 510 and the second rotating body 520 are closely coupled to each other, and two half tubes may be provided when the first rotating body 510 and the second rotating body 520 are spaced apart from each other.

As such, in the vacuum cleaner 1 according to an embodiment of the present disclosure, the first rotating body 510 and the second rotating body 520 form a "variable nozzle". Further, the variable nozzle (the first rotating body 510 and the second rotating body 520) is used as a new nozzle other than the suction nozzle 300, and when the suction nozzle 300 is referred to as a first nozzle, the variable nozzle corresponds to a second nozzle.

The variable nozzle (the first rotating body 510 and the second rotating body 520) is coupled to the connection pipe 200 and thus is prevented from being lost, and the variable nozzle can be used as soon as the suction nozzle 300 is separated from the connection pipe 200 to be used as a nozzle other than the suction nozzle 300. Therefore, convenience of use can be significantly improved.

In addition, the first rotating body 510 and the second rotating body 520 may be positioned in close contact with the outer circumferential surface of the connection pipe 200 when the movable body 400 is in the first position. In particular, since each of the first rotating body 510 and the second rotating body 520 has a half tube shape, the first rotating body 510 and the second rotating body 520 may be in close contact with the outer circumferential surface of the connection pipe 200, and an increase in volume due to the first rotating body 510 and the second rotating body 520 can be minimized.

The first rotating body 510 includes a first half tube 511 and a first connector 512. The first half tube 511 has a half tube shape, and includes a first edge 511*a* and a second edge 511*b* that are parallel to each other. The first connector 512 extends from the outside of the first half tube 511 and is rotatably coupled to the first fixing bracket 420.

The second rotating body 520 includes a second half tube 521 and a second connector 522. The second half tube 521 has a half tube shape, and includes a third edge 521*a* and a fourth edge 521*b* that are parallel to each other. The second half tube 521 is symmetrical with the first half tube 511 with respect to the central surface CS. The second connector 522 extends from the outside of the second half tube 521 and is rotatably coupled to the second fixing bracket 430. The second connector 522 is symmetrical with the first connector 512 with respect to the central surface CS.

The vacuum cleaner 1 may include a first rotation spring 530 and a second rotating spring 540. Each of the first rotation spring 530 and the second rotation spring 540 may have a plate spring shape. The first rotation spring 530 may be symmetrical with the second rotation spring 540 with respect to the central surface CS.

The first rotating spring 530 is coupled to the first fixing bracket 420 and the first connector 512, and is configured to elastically support the first rotating body 510 so that the front end of the first rotating body 510 (the front end with respect to the first direction X2) is rotated toward the second rotating body 520.

The second rotating spring 540 is coupled to the second fixing bracket 430 and the second connector 522, and is configured to elastically support the second rotating body 520 so that the front end of the second rotating body 520 (the front end with respect to the first direction X2) is rotated toward the first rotating body 510.

When the movable body 400 is in the first position, the first rotating body 510 is maintained in a state of being in close contact with the outer surface of the connection pipe 200 by the first rotation spring 530, and the second rotating body 520 is maintained in a state of being in close contact with the outer surface of the connection pipe 200 by the second rotation spring 540.

When the movable body 400 is in the second position, the first rotating body 510 is rotated by the first rotation spring 530 and the second rotating body 520 is rotated by the second rotation spring 540, and accordingly, the first rotating body 510 and the second rotating body 520 form the second suction port 501.

When the first rotating body 510 and the second rotating body 520 form the second suction port 501, the first edge 511*a* is in close contact with the third edge 521*a* and the second edge 511*b* is in close contact with the fourth edge 521*b*. When the first rotating body 510 and the second rotating body 520 form the second suction port 501, the cross-sectional areas of the inner spaces of the first rotating body 510 and the second rotating body 520 may be narrowed toward the front in the first direction X2. That is, the second suction port 501 may be configured to have a shape having a relatively narrow interval, and the width of the second suction port 501 may be smaller than the inner diameter of the first connection portion 210. When the first rotating body 510 and the second rotating body 520 form the second suction port 501, the combined first rotating body 510 and the second rotating body 520 may form one crevice tool or crevice nozzle shape.

In the vacuum cleaner 1 according to an embodiment of the present disclosure, a first reception portion (or first recess) 342 and a second reception portion (or second recess) 343 may be disposed in the connection neck 302. Each of the first reception portion 342 and the second reception portion 343 forms a rear end portion of the connection neck 302 with respect to the first direction X2. If the first reception portion 342 forms a left rear end of the connection neck 302, the second reception portion 343 may form a right rear end of the connection neck 302. The first reception portion 342 and the second reception portion 343 form an inner space of the connection neck 302, and the first reception portion 342 and the second reception portion 343 allow the inner space of the connection neck 302 to expand while moving away from each other in opposite directions.

Therefore, with respect to the first direction X2, the inner space and width of the connection neck 302 right in front of the first reception portion 342 and the second reception portion 343 are configured to be narrower than the inner space and width of the connection neck 302 in the part where the first reception portion 342 and the second reception portion 343 are disposed. In a state in which the connection neck 302 is coupled to the connection pipe 200, the first reception portion 342 is configured to receive the first rotating body 510 and the second reception portion 343 is configured to receive the second rotating body 520.

Figure 13:
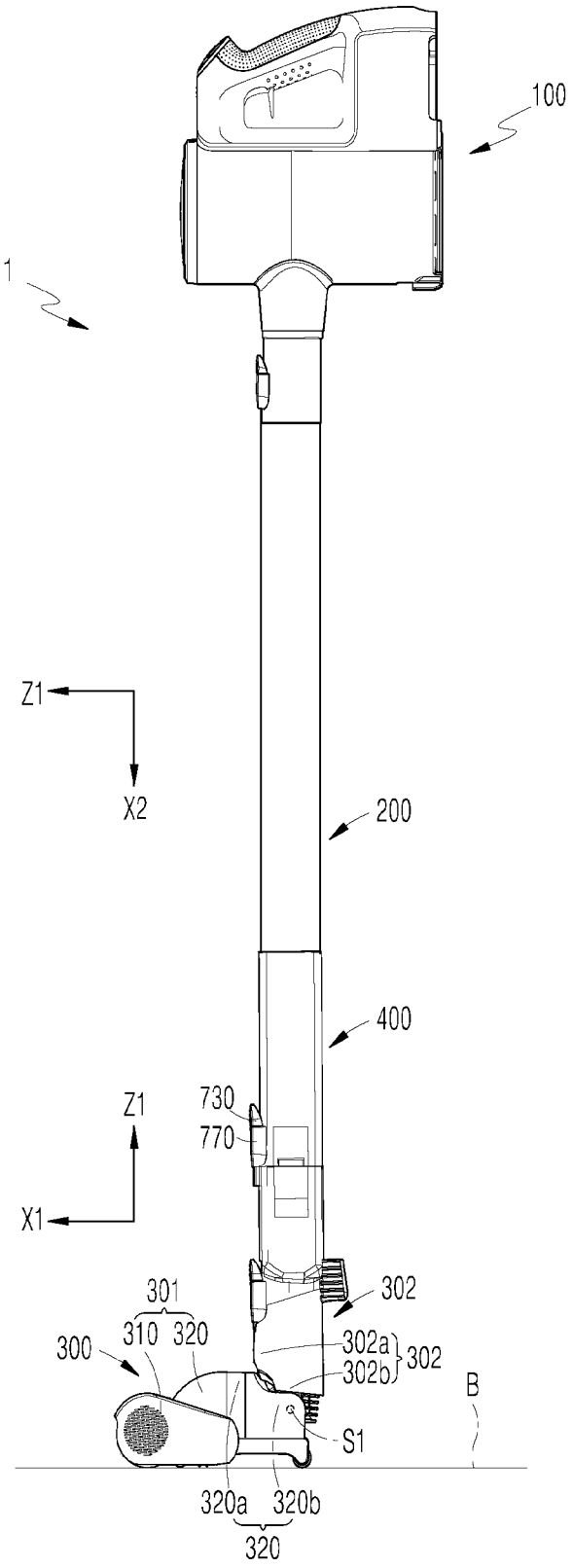
FIG. 13 illustrates a state in which a connection pipe of a vacuum cleaner is stood upright to be perpendicular to the floor surface.
Figure 14A:
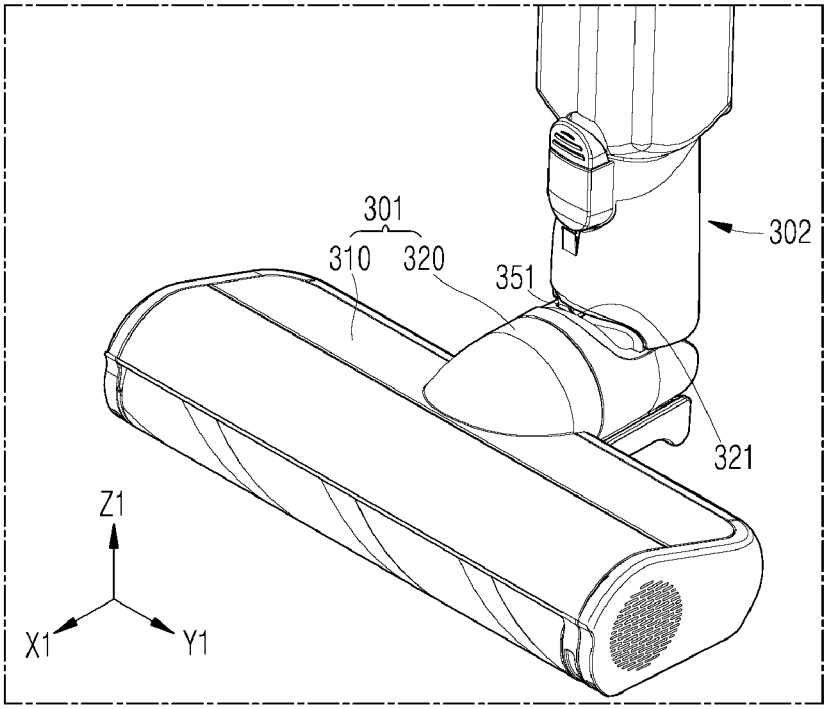
FIG. 14A is an enlarged perspective view of a suction nozzle part in FIG. 13.
Figure 14B:
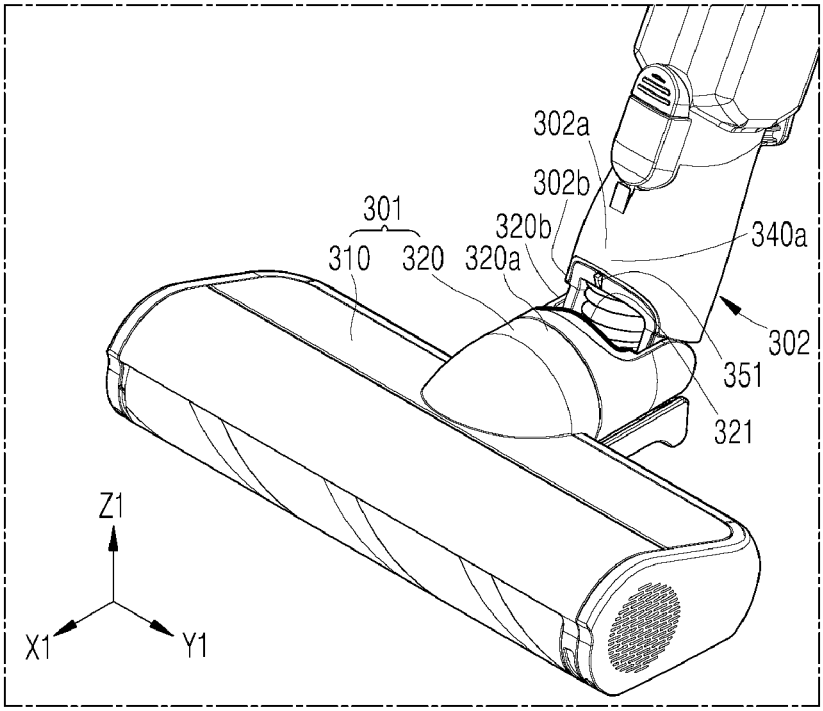
FIG. 14B is a perspective view illustrating a state in which a connection neck has been rotated relative to a nozzle housing in the vacuum cleaner of FIG. 14A.
Figure 15A:
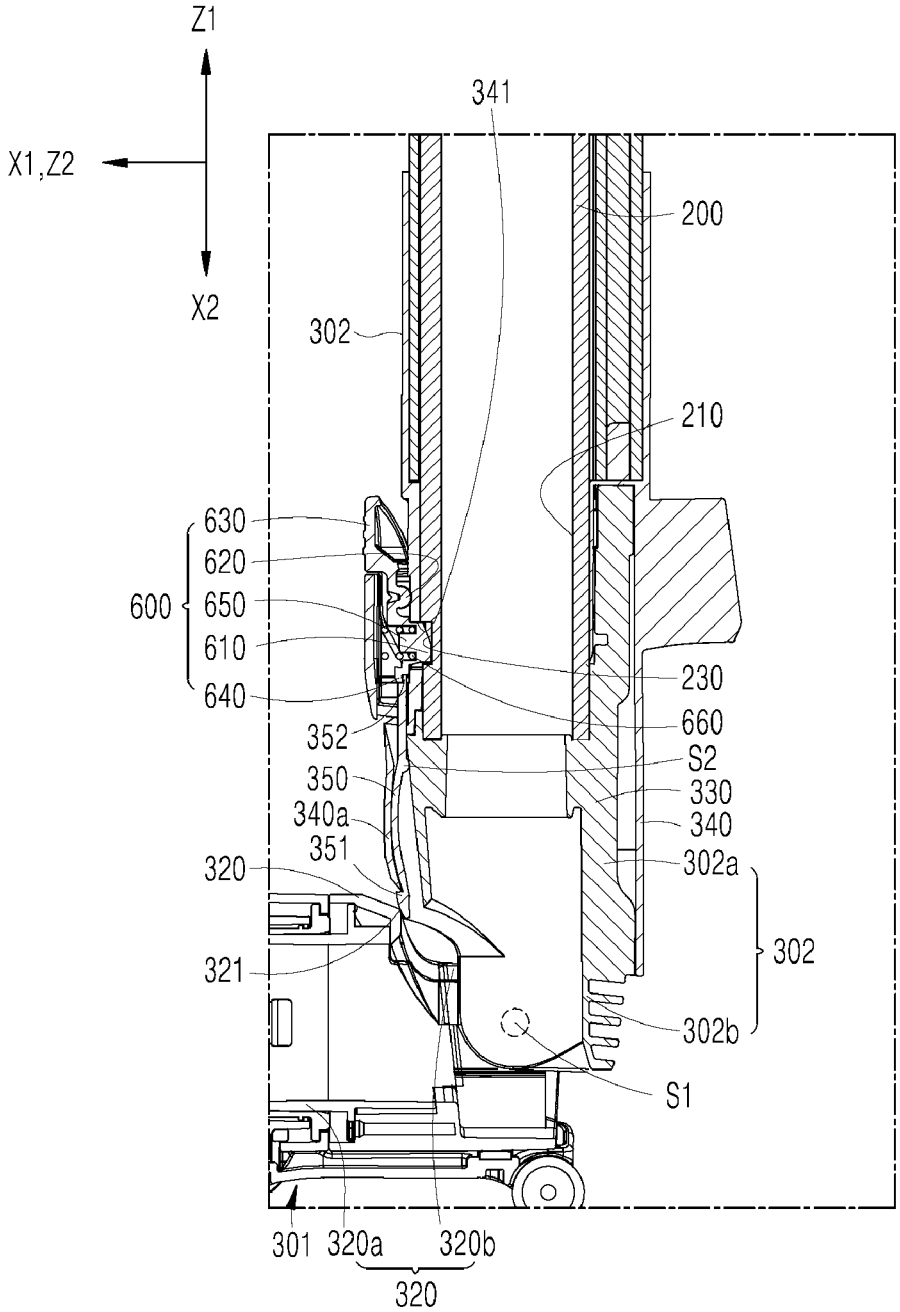
FIG. 15A is a cross-sectional view illustrating a vacuum cleaner in the state of FIG. 14A.
Figure 15B:
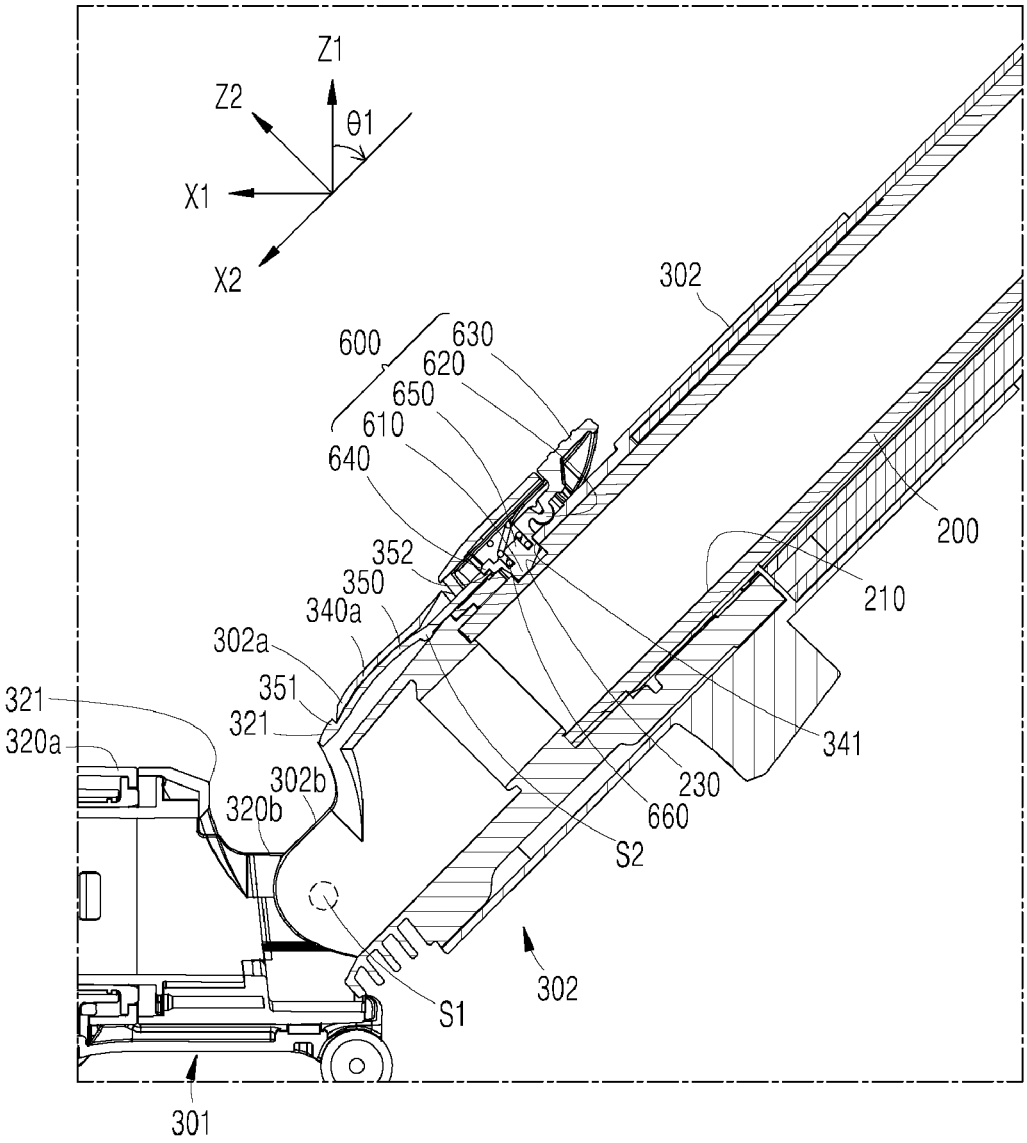
FIG. 15B is a cross-sectional view illustrating a state in which a connection pipe and a connection neck have been rotated in a rear direction of a suction nozzle in the vacuum cleaner of FIG. 15A.
Figure 15C:
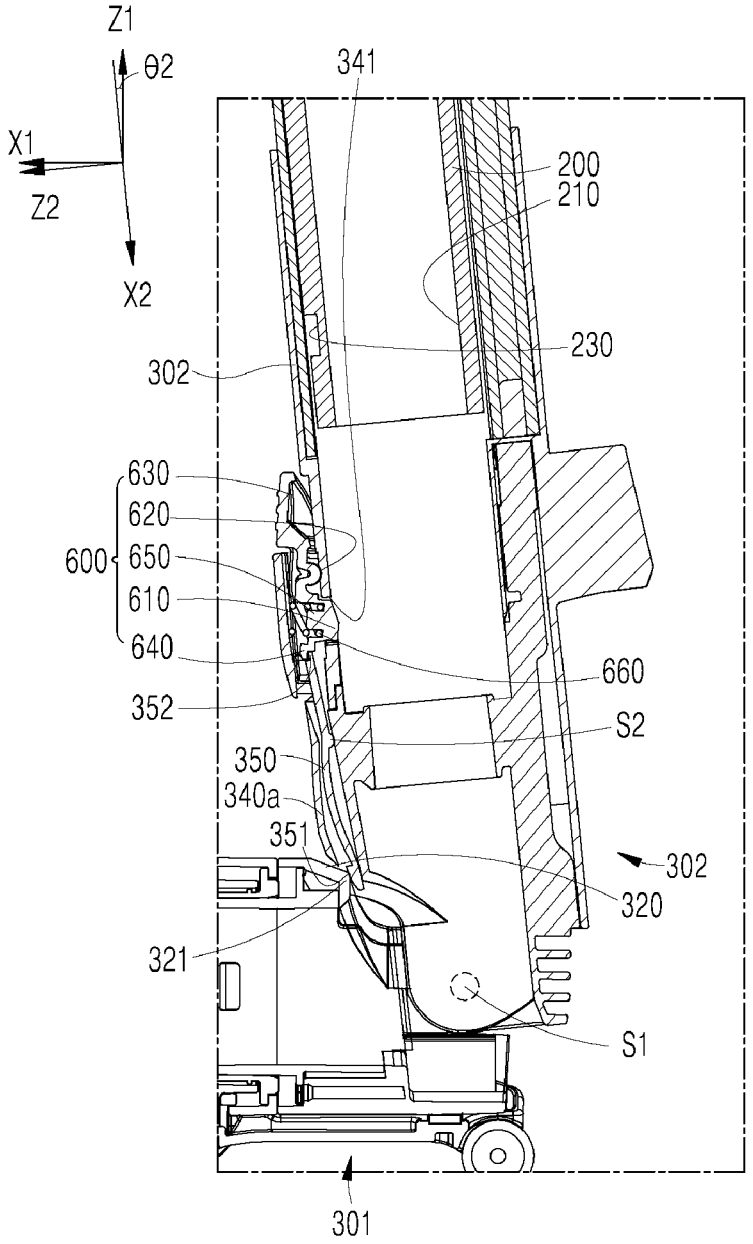
FIG. 15C is a cross-sectional view illustrating a state in which the connection pipe and the connection neck have been rotated in a forward direction of the suction nozzle in the vacuum cleaner of FIG. 15A.

FIG. 13 illustrates a state in which the connection pipe 200 of the vacuum cleaner 1 is stood upright to be perpendicular to the floor surface B. FIG. 14A is an enlarged perspective view of the part of the suction nozzle 300 in FIG. 13, and FIG. 14B is a perspective view illustrating a state in which the connection neck 302 is rotated relative to the nozzle housing 301 in the vacuum cleaner 1 of FIG. 14A. FIG. 15A is a cross-sectional view illustrating the vacuum cleaner 1 in the state of FIG. 14A, FIG. 15B is a cross-sectional view illustrating a state in which the connection pipe 200 and the connection neck 302 have been rotated in a rear direction of the suction nozzle 300 in the vacuum cleaner 1 of FIG. 15A, and FIG. 15C is a cross-sectional view illustrating a state in which the connection pipe 200 and the connection neck 302 have been rotated in a forward direction of the suction nozzle 300 in the vacuum cleaner 1 of FIG. 15A.

The vacuum cleaner 1 includes a first catching groove 230, a first catching body (or first latch) 600, and a first elastic body (or spring) 660. The first catching groove 230 may have a concave groove shape on the outer surface of the first connection portion 210.

In an embodiment, the first catching groove 230 may be disposed in front of the first connection portion 210 in the third direction Z2. Therefore, when the connection pipe 200 is placed parallel to the floor surface B, the first catching groove 230 may be said to be positioned on the upper side of the connection pipe 200 (the first connection portion 210), and when the connection pipe 200 is stood upright to be perpendicular to the floor surface B, the first catching groove 230 may be said to be positioned on the front side of the connection pipe 200 (the first connection portion 210).

The connection neck 302 is detachably coupled to the first connection portion 210 of the connection pipe 200. Both the connection neck 302 and the first connection portion 210 may have a tube shape, and may be coupled to each other in such a form that one of the connection neck 302 or the first connection portion 210 is fitted into the other thereof.

In an embodiment, the connection neck 302 and the first connection portion 210 may be coupled to each other while the first connection portion 210 is inserted (fitted) into the connection neck 302. That is, the first connection portion 210 may be inserted into the connection neck 302 while moving in the first direction X2, so that the first connection portion 210 and the connection neck 302 are coupled to each other.

The connection neck 302 and the first connection portion 210 are coupled to fit each other exactly. That is, in a state in which the connection neck 302 and the first connection portion 210 are coupled, there is no movement in the direction orthogonal to the first direction X2 between the connection neck 302 and the first connection portion 210.

The connection neck 302 may include an inner tube 330, an outer tube 340, and a first button cover 670. The inner tube 330 has a tube shape, and the inside of the inner tube 330 is configured to communicate with the inside of the connection pipe 200.

A first lever bracket 331 to which a first lever 350 to be described below is rotatably coupled may be disposed on the outer surface of the inner tube 330. The first lever bracket 331 may be disposed in front of the inner tube 330 in the third direction Z2. The first lever bracket 331 is configured to protrude outward from the inner tube 330, and is elongated in the first direction X2. A pair of first lever brackets 331 may be disposed to be parallel to each other, and the first lever 350 may be rotatably coupled between the pair of first lever brackets 331. The width between the pair of first lever brackets 331 may be equal to or slightly larger than the width of the first lever 350.

A second lever bracket 332 to which a second lever 360 to be described below is rotatably coupled may be disposed on the outer surface of the inner tube 330. The second lever bracket 332 is configured to protrude outward from the inner tube 330. The second lever bracket 332 may protrude from the inner tube 330 in a direction parallel to the second direction Y2. A pair of second lever brackets 332 may be disposed to be parallel to each other along the first direction X2, and the second lever 360 may be rotatably coupled between the pair of second lever brackets 332. The width between the pair of second lever brackets 332 may be equal to or slightly larger than the width of the second lever 360.

The outer tube 340 is positioned outside the inner tube 330. The outer tube 340 may have a tube shape, and may be configured to surround the inner tube 330. The outer tube 340 may include a first opening 341, which is a through-hole.

The first opening 341 is disposed in front of the outer tube 340 in the third direction Z2. The first opening 341 may be disposed at a position corresponding to the first catching body 600, and particularly, may be disposed at a position corresponding to a first catching protrusion portion 610 of the first catching body 600.

The outer tube 340 may include a skirt portion (or skirt) 340*a*. The skirt portion 340*a* forms a part of the outer tube 340, and is positioned outside the inner tube 330. The skirt portion 340*a* forms the front part of the outer tube 340 with respect to the first direction X2, and also forms the front part of the outer tube 340 in the third direction Z2.

An end portion edge of the skirt portion 340*a* may have a curved shape, and particularly, may have a concave curved shape. The first lever bracket 331 may be positioned directly inside the skirt portion 340*a*. The first button cover 670 is configured to cover the first opening 341, and is fixedly coupled to the outer tube 340 at the outside of the first catching body 600.

The first lever 350 may be positioned between the inner tube 330 and the outer tube 340. In addition, a first end portion 351 of the first lever 350 may protrude out of the outer tube 340. Particularly, the first end portion 351 of the first lever 350 protrudes out of an end portion of the skirt portion 340*a*.

The first catching body 600 includes the first catching protrusion portion (or catching protrusion) 610. In addition, the first catching body 600 further includes a first rotation center portion 620, a first button portion 630, and a first lift portion 640. All of the first catching protrusion portion 610, the first rotation center portion 620, the first button portion 630, and the first lift portion 640 may be integrally configured.

The first catching body 600 is coupled to the connection neck 302 so as to be rotatable about a third rotation shaft S3. The first catching body 600 may be coupled to the front of the connection neck 302 in the third direction Z2. The third rotation shaft S3 of the first catching body 600 may be disposed parallel to the second direction Y2.

The first rotation center portion 620 forms a rotation shaft (the third rotation shaft S3) of the first catching body 600. The first rotation center portion 620 is positioned at a position farther from the first rotation shaft S1 than the first catching protrusion portion 610. The first rotation center portion 620 may be supported by one side of the connection neck 302.

The first catching protrusion portion 610 protrudes in the direction toward the inside of the connection neck 302. That is, the first catching protrusion portion 610 has a shape protruding in the opposite direction to the third direction Z2. The first catching protrusion portion 610 may protrude in the direction toward the inside of the connection neck 302 through the first opening 341. According to the degree of rotation of the first catching body 600 relative to the connection neck 302, the first catching protrusion portion 610 may protrude further inward than the inner surface of the connection neck 302. Alternatively, the first catching protrusion portion 610 may be positioned further outside than the inner surface of the connection neck 302 or at the same position as the inner surface thereof.

In a state in which the first catching protrusion portion 610 protrudes further inward than the inner surface of the connection neck 302, the first catching protrusion portion 610 is inserted into and caught by the first catching groove 230. The first button portion 630 may be disposed on the opposite side of the first catching protrusion portion 610 with respect to the first rotation center portion 620. The first button portion 630 extends from the first rotation center portion 620 and protrudes out of the first button cover 670. The first button portion 630 is spaced apart from the outer surface of the connection neck 302 on the outside of the connection neck 302, and a user may press the first button portion 630 so as to rotate the first catching body 600 by using the first rotation center portion 620 as a rotation shaft.

The first lift portion 640 may extend from the first catching protrusion portion 610 and form an end portion of the first catching body 600. The first lift portion 640 is disposed at a position closer to the first rotation shaft S1 than the first catching protrusion portion 610, and the first lift portion 640 is configured to be in contact with a second end portion 352 of the first lever 350 at the outside of the second end portion 352.

The first elastic body 660 may have a coil spring shape. The first elastic body 660 is configured to elastically support the first catching body 600 such that the first catching protrusion portion 610 protrudes to the inside of the connection neck 302. The first elastic body 660 is configured to elastically support the first catching body 600 such that the first catching protrusion portion 610 is inserted into the first catching groove 230.

A first elastic body coupling portion 650 may be disposed in the first catching body 600. The first elastic body coupling portion 650 may be configured integrally with other components forming the first catching body 600. The first elastic body coupling portion 650 forms a space in which the first elastic body 660 is coupled between the first button cover 670 and the first elastic body coupling portion 650. When the first catching protrusion portion 610 is a surface facing the inside of the connection neck 302, the first elastic body coupling portion 650 may be a surface facing the outside of the connection neck 302.

When no separate external force is applied in a state where the first connection portion 210 is inserted into the connection neck 302 (when a separate external force does not act on the first button portion 630), the state in which the first catching protrusion portion 610 is inserted into the first catching groove 230 is maintained by the first elastic body 660. In this case, the coupling (fastening) of the connection pipe 200 (the first connection portion 210) and the suction nozzle 300 (the connection neck 302) is maintained.

When the first button portion 630 is pressed so as to rotate the first catching body 600 in a state in which the first connection portion 210 is inserted into the connection neck 302, the first elastic body 660 is compressed and the first catching protrusion portion 610 is separated from the first catching groove 230. Accordingly, the connection pipe 200 (the first connection portion 210) is in a state of being separable from the suction nozzle 300 (the connection neck 302), and a user can separate the connection pipe 200 from the suction nozzle 300 by pulling the connection pipe 200 in the direction opposite to the first direction X2.

The suction nozzle 300 may further include a pressing portion (or pressing surface) 321 and the first lever 350. The pressing portion 321 is disposed on the nozzle housing 301. Particularly, the pressing portion 321 is disposed on the nozzle neck portion 320 of the nozzle housing 301 and at an upper rear end of the nozzle neck portion 320. The pressing portion 321 may form a part of the edge of the upper rear end of the nozzle neck portion 320.

The first lever 350 generally has the shape of a rod that is elongated along the first direction X2. The first lever 350 is coupled to the connection neck 302 so as to be rotatable about a second rotation shaft S2 parallel to the first rotation shaft S1. The first lever 350 may be rotatably coupled to the first lever bracket 331. The second rotation shaft S2 may be positioned closer to the first rotation shaft S1 than the third rotation shaft S3.

The first lever 350 includes the first end portion 351 and the second end portion 352. The first end portion 351 and the second end portion 352 are disposed opposite to each other with respect to the second rotation shaft S2. The first end portion 351 and the second end portion 352 form opposite end portions of the first lever 350, respectively. With respect to the first direction X2, the first end portion 351 is the front part of the first lever 350 and the second end portion 352 is the rear part of the first lever 350.

The first end portion 351 is in contact with the pressing portion 321, and the second end portion 352 is configured to press (rotate) the first lift portion 640 of the first catching body 600. Particularly, the second end portion 352 is configured to lift the first lift portion 640 of the first catching body 600 such that the catching of the first catching groove 230 and the first catching protrusion portion 610 is released.

When the first end portion 351 is pressed by the pressing portion 321 to rotate the first lever 350, the second end portion 352 rotates the first catching body 600. In this case, the first elastic body 660 is compressed and the first catching protrusion portion 610 is separated from the first catching groove 230.

Accordingly, the connection pipe 200 (the first connection portion 210) is in a state of being separable from the suction nozzle 300 (the connection neck 302), and a user can separate the connection pipe 200 from the suction nozzle 300 by pulling the connection pipe 200 in the direction opposite to the first direction X2.

In the vacuum cleaner 1 according to the embodiment of the present disclosure, the length from the second rotation shaft S2 to the first end portion 351 may be longer than the length from the second rotation shaft S2 to the second end portion 352. Accordingly, when the first end portion 351 is pressed by the pressing portion 321, the second end portion 352 may rotate the first catching body 600 more easily.

The nozzle neck portion 320 may be divided into a front portion 320*a* and a rear portion 320*b*. When the suction nozzle 300 is placed on a flat floor in a horizontal direction, the front portion 320*a* forms the front part of the nozzle neck portion 320, and the rear portion 320*b* forms the rear part of the nozzle neck portion 320.

The front portion 320*a* has a tube shape and is fixed to the nozzle head portion 310. The rear portion 320*b* extends rearward from the rear of the front portion 320*a*, and has a rear part having an open upper side.

That is, the front portion 320*a* is a part having a general tube shape, and the rear portion 320*b* has a tube shape of which the upper part of the rear side is removed. The upper rear end edge of the rear portion 320*b* is positioned in front of the rear end edge of the other part of the rear portion 320*b*. The rear end edge of the rear portion 320*b* may be configured to form a curve overall, and the upper rear end edge of the rear portion 320*b* may also be configured to form a curve overall.

A rotation shaft (the first rotation shaft S1) of the nozzle neck portion 320 is disposed in the rear portion 320*b*. The pressing portion 321 is disposed at the upper rear end of the rear portion 320*b*. The pressing portion 321 may form an upper rear edge part of the rear portion 320*b*.

In an embodiment, the front portion 320*a* and the rear portion 320*b* may be fixed to each other. In another embodiment, the front portion 320*a* and the rear portion 320*b* may be rotatably coupled to each other. In this case, relative to the front portion 320*a*, the rear portion 320*b* may be rotated using a central axis of the nozzle neck portion 320 as a rotation axis (a rotation axis of the rear portion 320*b* may be parallel to X1 or substantially parallel to X1).

The connection neck 302 may be divided into an upper portion 302*a* and a lower portion 302*b*. When the connection neck 302 is stood upright such that the longitudinal direction thereof is perpendicular to the floor surface B, the upper portion 302*a* is the upper part of the connection neck 302, and the lower portion 302*b* is the lower part of the connection neck 302.

The upper portion 302*a* has a tube shape. The lower portion 302*b* extends forward in the first direction X2 from the upper portion 302*a*. The lower portion 302*b* has a shape in which the front part of the lower portion 302*b* in the third direction Z2 is opened. That is, the upper portion 302*a* is a part having a general tube shape, and the lower portion 302*b* has a tube shape, the front part of which in the third direction Z2 is removed.

In a state in which the connection neck 302 is stood upright such that that the first end portion 351 is in contact with the pressing portion 321, the lower edge of the upper portion 302*a* may be configured to form a curve overall, and the front end and lower edges of the lower portion 302*b* may also be configured to form a curve overall.

The rotation shaft (the first rotation shaft S1) of the nozzle neck portion 302 is disposed in the lower portion 302*b*. The first end portion 351 of the first lever 350 protrudes below the front lower end of the upper portion 302*a*.

As described above, the nozzle housing 301 and the connection neck 302 of the suction nozzle 300 are coupled to each other so as to be rotatable about the first rotation shaft S1, and the first rotation shaft S1 may be parallel (parallel left and right) to the floor surface B. Further, the connection pipe 200 is coupled to the connection neck 302. Accordingly, when the vacuum cleaner 1 is used, an angle formed by the connection pipe 200 and the nozzle housing 301 of the suction nozzle 300 may be changed, and an angle formed by the floor surface B and the first direction X2 may be changed.

In the vacuum cleaner 1 according to an embodiment of the present disclosure, when an angle formed by the nozzle housing 301 and the connection neck 302 (the connection pipe 200) is greater than a reference angle, the pressing portion 321 and the first lever 350 (the first end portion 351) may not be in contact with each other, and when the angle formed by the nozzle housing 301 and the connection neck 302 (the connection pipe 200) is smaller than the reference angle, the pressing portion 321 may be in contact with the first lever 350 (the first end portion 351), so that the first lever 350 is rotated by the pressing portion 321. That is, the reference angle may be an angle formed by the nozzle housing 301 and the connection neck 302 (or the connection pipe 200) when the pressing portion 321 and the first lever 350 (the first end portion 351) are in contact with each other, or may be an angle formed by the floor surface B and the first direction X2.

In an embodiment of the present disclosure, a state in which the first end portion 351 starts to contact the pressing portion 321 is referred to as a first state (see FIG. 15A). In the first state, the connection pipe 200 (the connection neck 302) may be rotated in the rear direction of the suction nozzle 300 (see FIG. 15B).

In an embodiment of the present disclosure, a state in which the connection pipe 200 (the connection neck 302) in the first state has been maximally rotated in the rear direction of the suction nozzle 300 is referred to as a second state.

Further, a state in which the connection pipe 200 (the connection neck 302) in the first state has been rotated in the frontward direction of the suction nozzle 300 to release the catching between the first catching groove 230 and the first catching protrusion portion 610 is referred to as a third state (see FIG. 15C).

In an embodiment of the present disclosure, a rotation angle θ1 of the connection pipe 200 (the connection neck 302) from the first state to the second state may be 60° or greater. For example, θ1 may be 70°, or 90°. In an embodiment of the present disclosure, a rotation angle θ2 of the connection pipe 200 (the connection neck 302) from the first state to the third state may be ⅓ or less of θ1. For example, θ2 may be 10°, or 20°. θ1 and θ2 may be set to various sizes according to the characteristics of the vacuum cleaner 1 used.

The reference angle may also be set to various sizes according to the characteristics of the vacuum cleaner 1 used. In addition, the reference angle may be a boundary between an angle range in which the vacuum cleaner 1 is used and an angle range in which the vacuum cleaner 1 is not used.

In an embodiment, the reference angle may be a predetermined angle from 80° to 100°. For example, the reference angle may be 90°. In an embodiment, in a case where the reference angle is 90°, when the angle formed by the nozzle housing 301 and the connection neck 302 (the connection pipe 200) exceeds 90°, the pressing portion 321 and the first lever 350 are not in contact with each other. In this case, θ1 may be 90°. That is, in the range in which the angle formed by the nozzle housing 301 and the connection neck 302 (the connection pipe 200) is 90° to 180°, a user can use the vacuum cleaner 1 without separation between the suction nozzle 300 and the connection pipe 200.

Further, while the reference angle is 90°, θ2 may be 15°. In this case, by rotating the connection pipe 200 relative to the suction nozzle 300 so that the angle formed by the nozzle housing 301 and the connection neck 302 (the connection pipe 200) is 90° or less (for example, 75°) (rotating the connection pipe 200 forward), the first lever 350 may be pressed by the pressing portion 321 and rotated.

Accordingly, the connection pipe 200 (the first connection portion 210) is in a state of being separable from the suction nozzle 300 (the connection neck 302), and a user can separate the connection pipe 200 from the suction nozzle 300 by pulling the connection pipe 200 in the direction opposite to the first direction X2.

As described above, according to the vacuum cleaner 1 according to an embodiment of the present disclosure, when the angle formed by the nozzle housing 301 and the connection neck 302 is in an angle range equal to or greater than the reference angle (for example, 90° to 180°), a user can freely use the vacuum cleaner 1 without separation of the suction nozzle 300 and the connection pipe 200.

By rotating the connection pipe 200 relative to the suction nozzle 300 forward (rotating the connection pipe such that the angle formed by the nozzle housing 301 and the connection neck 302 is less than or equal to the reference angle), the connection pipe 200 may be simply separated from the suction nozzle 300. That is, a user can separate the connection pipe 200 from the suction nozzle 300 only by rotating the cleaner body 100 (or the connection pipe 200) toward the front of the suction nozzle 300 while holding the cleaner body 100 (or the connection pipe 200) with one hand.

As described above, the first lever 350 is positioned between the inner tube 330 and the outer tube 340, and accordingly, the first lever 350 does not interfere with the corrugated tube 304 disposed in the connection neck 302, the first lever 350 does not interfere with the flow of air or dust moving into the connection neck 302, and thus a stable operation (rotation) of the first lever 350 may be performed.

Figure 16A:
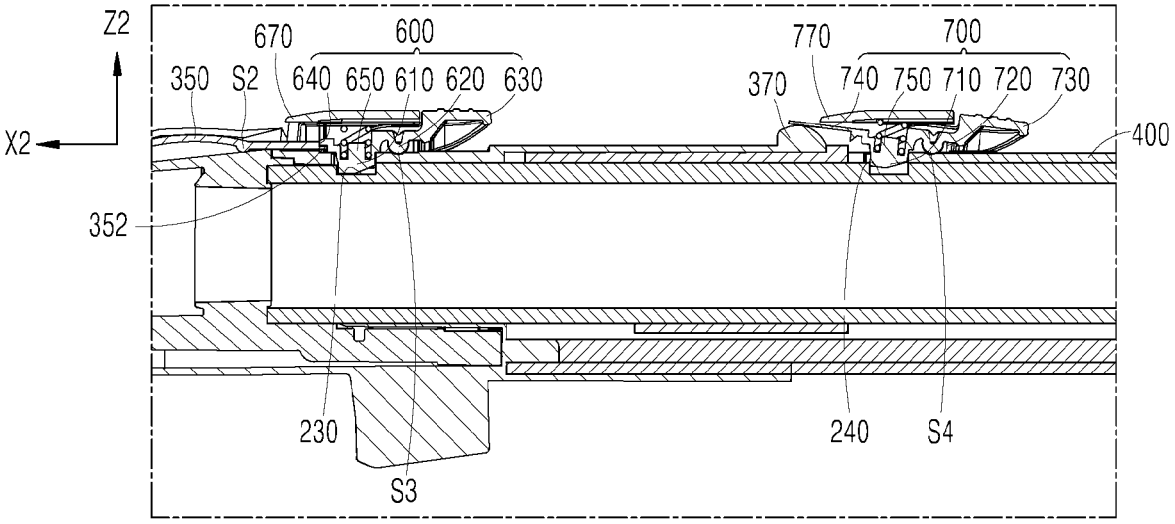
FIG. 16A is a cross-sectional view illustrating a partial configuration of a vacuum cleaner according to an embodiment of the present disclosure.
Figure 16B:
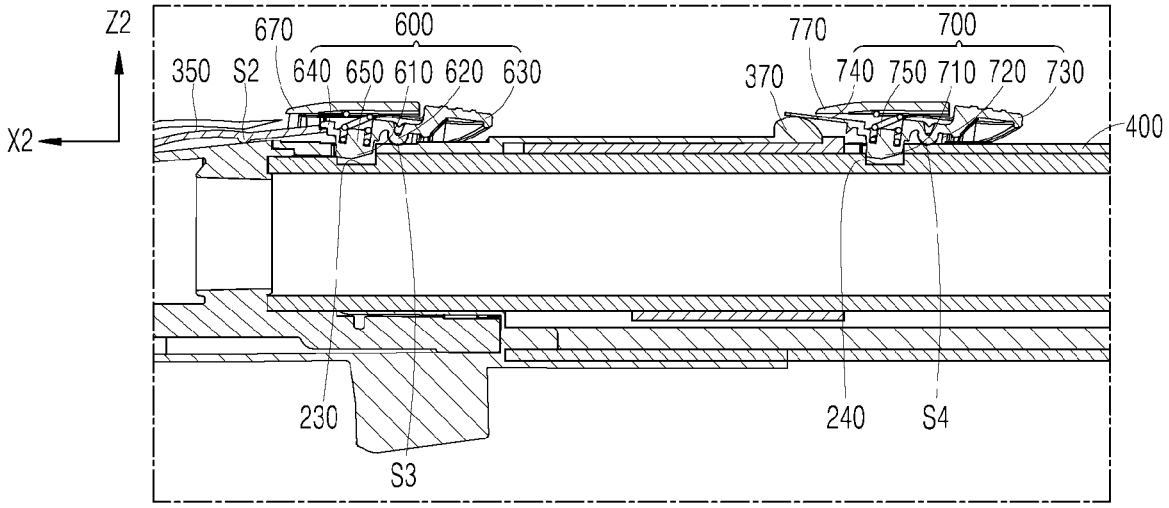
FIG. 16B is a cross-sectional view illustrating a state in which a first catching body has been rotated in the vacuum cleaner of FIG. 16A.
Figure 16C:
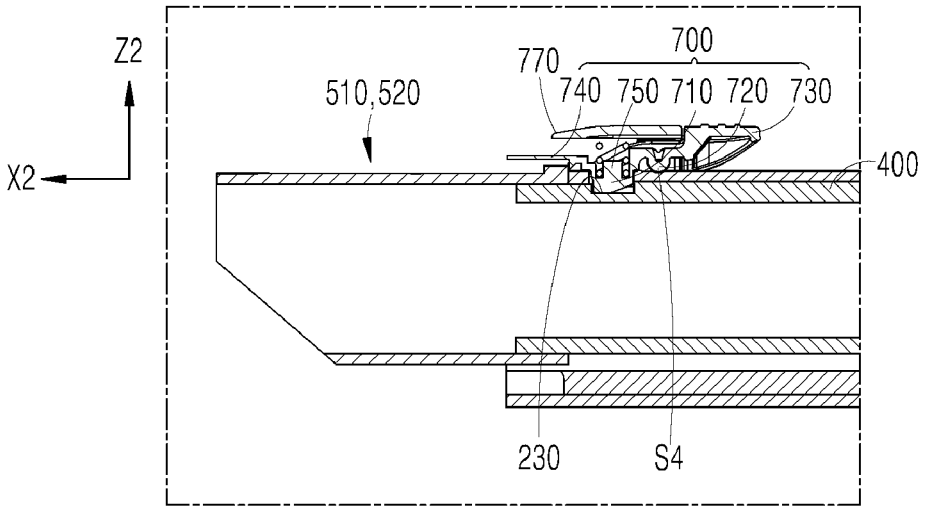
FIG. 16C is a cross-sectional view illustrating a state in which a suction nozzle and a connection pipe are separated and a movable body has moved to a second position in the vacuum cleaner of FIG. 16B.

FIG. 16A is a cross-sectional view illustrating a partial configuration of the vacuum cleaner 1 according to an embodiment of the present disclosure, FIG. 16B is a cross-sectional view illustrating a state in which the first catching body 600 has been rotated in the vacuum cleaner 1 of FIG. 16A, and FIG. 16C is a cross-sectional view illustrating a state in which the suction nozzle 300 and the connection pipe 200 are separated and the movable body 400 has moved to the second position in the vacuum cleaner 1 of FIG. 16B.

The vacuum cleaner 1 includes a second catching groove 240, a second catching body (or second latch) 700, and a second elastic body (or second spring) 760. The second catching groove 240 may be configured to have a concave groove shape on the outer surface of the connection pipe 200. The second catching groove 240 is disposed on the outer surface of the connection pipe 200 behind the first catching groove 230 with respect to the first direction X2.

In an embodiment, the second catching groove 240 may be disposed in front of the connection pipe 200 in the third direction Z2. In addition, the second catching groove 240 may be disposed on the same line as the first catching groove 230 along the first direction X2. Therefore, when the connection pipe 200 is placed parallel to the floor surface B, the second catching groove 240 may be said to be positioned on the upper side of the connection pipe 200, and when the connection pipe 200 is stood upright to be perpendicular to the floor surface B, the second catching groove 240 may be said to be positioned on the front side of the connection pipe 200.

The second catching body 700 includes a second catching protrusion portion 710. In addition, the second catching body 700 further includes a second rotation center portion 720, a second button portion 730, and a second lift portion 740. All of the second catching protrusion portion 710, the second rotation center portion 720, the second button portion 730, and the second lift portion 740 may be integrally configured.

The second catching body 700 is coupled to the movable body 400 so as to be rotatable about a fourth rotation shaft S4. The second catching body 700 may be coupled to the front of the movable body 400 in the third direction Z2. The fourth rotation shaft S4 of the second catching body 700 may be parallel to the second direction Y2.

The second rotation center portion 720 forms a rotation shaft (the fourth rotation shaft S4) of the second catching body 700. The second rotation center portion 720 may be supported by one side of the movable body 400.

The second catching protrusion portion 710 protrudes in the direction toward the inside of the movable body 400. That is, the second catching protrusion portion 710 has a shape protruding in the opposite direction to the third direction Z2. According to the degree of rotation of the second catching body 700 relative to the movable body 400, the second catching protrusion portion 710 may protrude further inward than the inner surface of the movable body 400. Alternatively, the second catching protrusion portion 710 may be positioned further outside than the inner surface of the movable body 400 or at the same position as the inner surface thereof.

A second opening 411, which is a through-hole, may be disposed in the movable body 400, and the second catching protrusion portion 710 may protrude in the direction toward the inside of the movable body 400 through the second opening 411 and move. A second button cover 770 may be coupled to the movable body 400. The second button cover 770 is configured to cover the second opening 411, and is fixedly coupled to the movable body 400 on the outside of the second catching body 700. In a state in which the second catching protrusion portion 710 protrudes further inward than the inner surface of the movable body 400, the second catching protrusion portion 710 is inserted into and caught by the second catching groove 240.

The second button portion 730 may be disposed on the opposite side of the second catching protrusion portion 710 with respect to the second rotation center portion 720. The second button portion 730 extends from the second rotation center portion 720 and protrudes out of the second button cover 770. The second button portion 730 is spaced apart from the outer surface of the movable body 400 on the outside of the movable body 400, and a user may press the second button portion 730 so as to rotate the second catching body 700 by using the second rotation center portion 720 as a rotation shaft.

The second lift portion 740 may extend from the second catching protrusion portion 710 and form the end portion of the second catching body 700. The second lift portion 740 is positioned at a position closer to the first rotation shaft S1 than the second catching protrusion portion 710. The second lift portion 740 is in contact with a catching release protrusion 370 at the outside of the catching release protrusion 370.

The second elastic body 760 may have a coil spring shape. The second elastic body 760 is configured to elastically support the second catching body 700 such that the second catching protrusion portion 710 protrudes to the inside of the movable body 400. The second elastic body 760 is configured to elastically support the second catching body 700 such that the second catching protrusion portion 710 is inserted into the second catching groove 240.

A second elastic body coupling portion 750 may be disposed in the second catching body 700. The second elastic body coupling portion 750 may be configured integrally with other components forming the second catching body 700. The second elastic body coupling portion 750 forms a space in which the second elastic body 760 is coupled between the second button cover 770 and the second elastic body coupling portion 750. When the second catching protrusion portion 710 is a surface facing the inside of the movable body 400, the second elastic body coupling portion 750 may be a surface facing the outside of the movable body 400.

In a case where the suction nozzle 300 and the connection pipe 200 are separated from each other and the movable body 400 is in the first position, when no separate external force is applied (when a separate external force does not act on the second button portion 730), the state in which the second catching protrusion portion 710 is inserted into the second catching groove 240 is maintained by the second elastic body 760. In this case, relative to the connection pipe 200, the movable body 400 is fixed to the first position.

If the second button portion 730 is pressed to rotate the second catching body 700 when the suction nozzle 300 and the connection pipe 200 are separated from each other and the movable body 400 is in the first position, the second elastic body 760 is compressed and the second catching protrusion portion 710 is separated from the second catching groove 240. Accordingly, while the movable body 400 is pressed by the coil spring 450, the movable body 400 is moved to the second position.

When the suction nozzle 300 and the connection pipe 200 are separated from each other and the movable body 400 is moved to the second position, the state in which the second catching protrusion portion 710 is inserted into the first catching groove 230 is maintained by the second elastic body 760. In this case, relative to the connection pipe 200, the movable body 400 is fixed to the second position.

If the second button portion 730 is pressed to rotate the second catching body 700 when the movable body 400 is in the second position, the second elastic body 760 is compressed and the second catching protrusion portion 710 is separated from the first catching groove 230. Accordingly, the movable body 400 can be moved again from the second position to the first position. When the movable body 400 is moved from the second position to the first position, the coil spring 450 is compressed and stores elastic energy.

As described above, as the movable body 400 coupled to the connection pipe 200 moves (reciprocates) along the first direction X2, the second catching protrusion portion 710 is inserted into and caught by the first catching groove 230 or the second catching groove 240, and the movable body 400 can be stably fixed in the first position or the second position.

The vacuum cleaner 1 may further include the catching release protrusion 370. The catching release protrusion 370 is disposed in the connection neck 302 of the suction nozzle 300.

In an embodiment, the catching release protrusion 370 may be disposed in front of the connection neck 302 in the third direction Z2. The catching release protrusion 370 may be disposed on the same line as the first catching body 600 along the first direction X2. In addition, the catching release protrusion 370 is disposed on the same line as the second catching body 700 along the first direction X2, and is disposed on the same line as the first catching groove 230 and the second catching groove 240.

The catching release protrusion 370 is disposed at the rear end of the connection neck 302 with respect to the first direction X2. Therefore, when the connection neck 302 is placed parallel to the floor surface B, the catching release protrusion 370 may be said to be positioned at the upper rear end of the connection neck 302, and when the connection neck 302 is stood upright to be perpendicular to the floor surface B, the catching release protrusion 370 may be said to be positioned at the front upper end of the connection neck 302.

The catching release protrusion 370 is configured to protrude outward from the outer surface of the connection neck 302. In addition, the catching release protrusion 370 is configured to protrude in the opposite direction to the first direction X2. Such a catching release protrusion 370 lifts the second lift portion 740 of the second catching body 700 such that the second catching protrusion portion 710 is separated from the second catching groove 240, and rotates the second catching body 700. In addition, the catching release protrusion 370 lifts the second lift portion 740 of the second catching body 700 such that the second catching protrusion portion 710 is separated from the first catching groove 230, and rotates the second catching body 700.

When the suction nozzle 300 and the connection pipe 200 are coupled to each other and the movable body 400 is in the first position, the catching release protrusion 370 is configured to press the second catching body 700 (the second lift portion 740). Accordingly, the second elastic body 760 is compressed, and the state in which the second catching protrusion portion 710 is separated from the second catching groove 240 is maintained.

When no separate external force is applied in a state in which the suction nozzle 300 and the connection pipe 200 are coupled to each other (when a separate external force does not act on the first button portion 630), the state in which the first catching protrusion portion 610 is inserted into the first catching groove 230 is maintained by the first elastic body 660. That is, if no separate external force is applied in the state in which the suction nozzle 300 and the connection pipe 200 are coupled to each other, the catching between the second catching protrusion portion 710 and the second catching groove 240 is released and the catching between the first catching protrusion portion 610 and the first catching groove 230 is maintained, and thus the coupling (fastening) between the suction nozzle 300 and the connection pipe 200 is maintained.

In a state in which the suction nozzle 300 and the connection pipe 200 are coupled to each other, when a user presses the first button portion 630 to rotate the first catching body 600, or the first lever 350 is pressed and rotated by the pressing portion 321 and thus the first catching body 600 is rotated, the first elastic body 660 is compressed and the first catching protrusion portion 610 is separated from the first catching groove 230. That is, the catching between the first catching protrusion portion 610 and the first catching groove 230 is released.

In addition, since the catching between the second catching protrusion portion 710 and the second catching groove 240 is in a released state, the connection pipe 200 is in a state of being separable from the suction nozzle 300. In this case, since the coil spring 450 presses the movable body 400 relative to the connection pipe 200, the movable body 400 is moved to the front of the connection pipe 200 with respect to the first direction X2.

When the suction nozzle 300 is placed on the floor, since the connection neck 302 and the movable body 400 cannot move downward to get closer to the floor surface B, the connection pipe 200 is moved rearward relative to the connection neck 302 and the moving body 400. That is, even when a user does not pull the connection pipe 200 from the suction nozzle 300 in the opposite direction to the first direction X2, the connection pipe 200 moves from the suction nozzle 300 in the opposite direction to the first direction X2, and the user can easily separate the connection pipe 200 from the suction nozzle 300.

When the suction nozzle 300 and the connection pipe 200 are separated from each other and the movable body 400 is in the second position, the catching between the second catching protrusion portion 710 and the first catching groove 230 is maintained. In this case, the first rotating body 510 and the second rotating body 520 form the second suction port 501, and a user can use the first rotating body 510 and the second rotating body 520 as a new nozzle.

Thereafter, if the suction nozzle 300 and the connection pipe 200 are coupled to each other again, first, the catching release protrusion 370 presses the second catching body 700, and accordingly, the second elastic body 760 is compressed and the second catching protrusion portion 710 is separated from the first catching groove 230.

If the suction nozzle 300 and the connection pipe 200 are further coupled to each other, the connection neck 302 moves the movable body 400 by pushing the same to the rear of the connection pipe 200 (the rear of the connection pipe in the first direction X2). If the connection neck 302 moves the movable body 400 to the first position, the catching release protrusion 370 still presses the second catching body 700, and the second catching protrusion portion 710 is in a state of being separated from the second catching groove 240. In this case, the first catching protrusion portion 610 is inserted into the first catching groove 230 to complete the coupling between the suction nozzle 300 and the connection pipe 200.

Figure 17A:
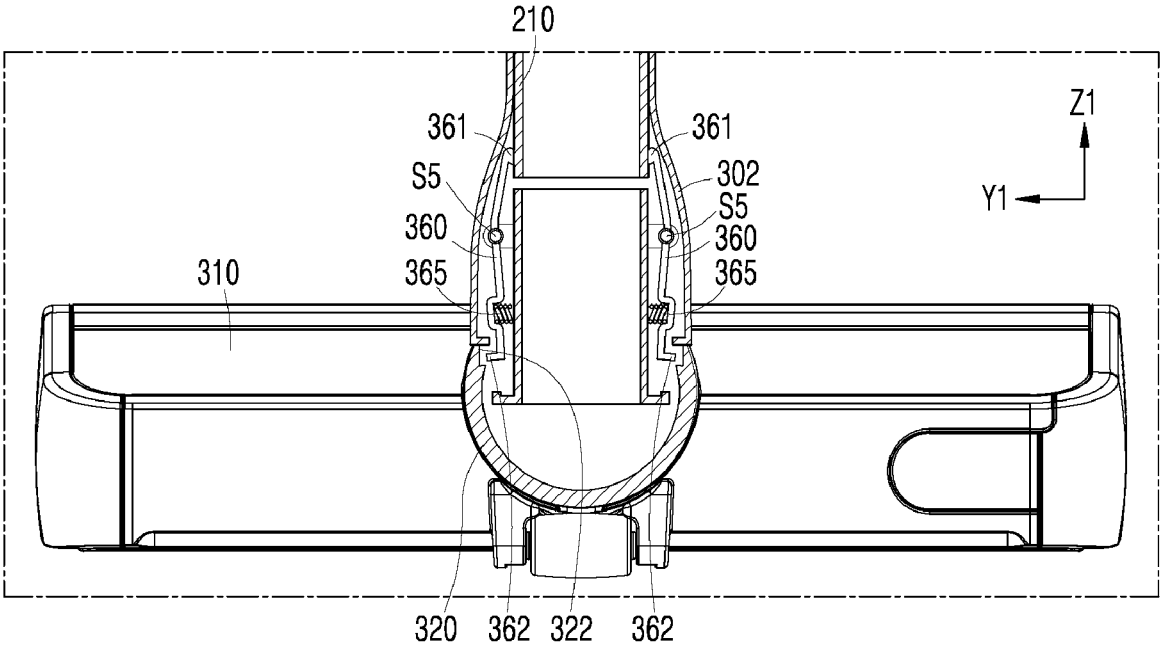
FIG. 17A is a view of a suction nozzle as viewed from the rear.
Figure 17B:
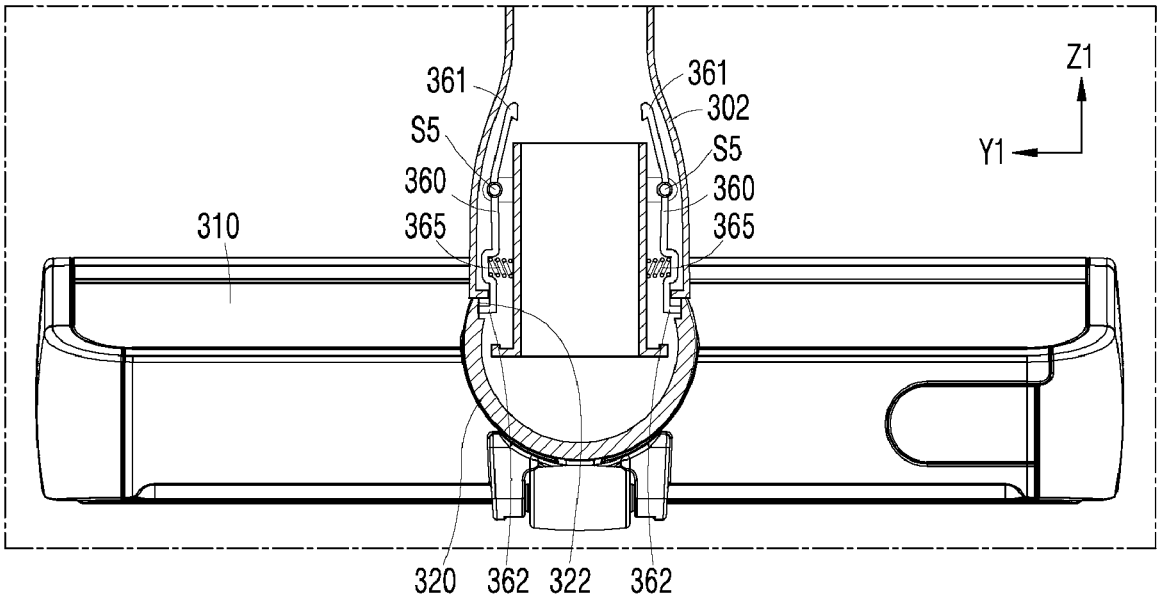
FIG. 17B is a view of the suction nozzle as viewed from the rear, whereby

FIG. 17A is a view of the suction nozzle 300 as viewed from the rear, and FIG. 17B is a view of the suction nozzle 300 as viewed from the rear. FIG. 17A and FIG. 17B illustrate partial configurations in a cross-sectional form.

The vacuum cleaner 1 according to an embodiment of the present disclosure may further include the second lever 360 and a third elastic body (or third spring) 365. Further, a stopping groove 322 may be disposed in the nozzle neck portion 320.

The stopping groove 322 may be configured to have a concave groove shape on the inner surface of the nozzle neck portion 320. The stopping groove 322 extends to the upper end of the nozzle neck portion 320. That is, the upper end of the stopping groove 322 is exposed when viewed from the upper side.

The second lever 360 generally has the shape of a rod that is elongated along the first direction X2. The second lever 360 is rotatably coupled to the connection neck 302. The second lever 360 may be rotatably coupled to the second lever bracket 332.

A rotation shaft of the second lever 360 may be parallel to the third direction Z2. The second lever 360 includes a first pressing end portion 361 and a stopping protrusion 362. The first pressing end portion 361 and the stopping protrusion 362 may form both ends of the second lever 360, respectively, and are disposed on the opposite sides with respect to a rotation shaft S5 of the second lever 360. With respect to the first direction X2, the stopping protrusion 362 may form the front part of the second lever 360, and the first pressing end portion 361 may form the rear part of the second lever 360.

The stopping protrusion 362 is inserted into the stopping groove 322 and caught by the stopping groove 322. The first pressing end portion 361 is in contact with the outer surface of the first connection portion 210 of the connection pipe 200 and is pressed by the first connection portion 210.

When the first pressing end portion 361 is pressed by the first connection portion 210 and the second lever 360 is thus rotated, the stopping protrusion 362 is separated from the stopping groove 322, and the catching between the stopping protrusion 362 and the stopping groove 322 is released.

The third elastic body 365 may have a coil spring shape. The third elastic body 365 is coupled to the inner side of the connection neck 302, and is configured to elastically support the second lever 360 such that the stopping protrusion 362 is inserted into the stopping groove 322.

In the vacuum cleaner 1, a pair of second levers 360 and a pair of third elastic bodies 365 may be provided. In addition, a plurality of second levers 360 and a plurality of third elastic bodies 365 may be provided.

When a pair of second levers 360 are provided, any one of the second levers 360 may be symmetrical with the other second lever 360 with respect to the central surface CS. When any one of the second levers 360 is positioned on the left side, the other second lever 360 may be positioned on the right side. When a pair of third elastic bodies 365 are provided, any one of the third elastic bodies 365 may be symmetrical with the other third elastic body 365 with respect to the central surface CS.

When the first connection portion 210 is inserted into the connection neck 302, the first connection portion 210 presses the first pressing end portion 361 to rotate the second lever 360, and accordingly, the third elastic body 365 is compressed and the state in which the stopping protrusion 362 is separated from the stopping groove 322 is maintained. Accordingly, the connection neck 302 may be freely rotated about the first rotation shaft S1 with respect to the nozzle housing 301 (the nozzle neck portion 320).

When the connection neck 302 is stood upright to be substantially perpendicular to the floor, the connection pipe 200 may be separated from the suction nozzle 300. In this case, since the pressing of the first pressing end portion 361 by the first connection portion 210 is released, the second lever 360 may be rotated by the elastic force of the third elastic body 365 and the stopping protrusion 362 may be inserted into the stopping groove 322.

Accordingly, the rotation between the nozzle housing 301 and the connection neck 302 (rotation about the first rotation shaft S1) is blocked (or limited), and a predetermined angle (for example, 90°) between the nozzle housing 301 and the connection neck 302 is maintained. As such, when the connection pipe 200 is separated from the suction nozzle 300, the connection neck 302 may be fixed in a standing state on the floor surface B.

Therefore, when a user desires to couple the connection pipe 200 to the suction nozzle 300 again, the user can couple the connection pipe 200 and the suction nozzle 300 by the operation of moving the connection pipe 200 and the like (including the movable body 400, the first rotating body 510, and the second rotating body 520) positioned above the connection neck 302 downwards.

In this case, since the suction nozzle 300 is placed on the floor surface B, the suction nozzle 300 is not unintentionally pushed and moved in another direction. That is, a user can couple the suction nozzle 300 and the connection pipe 200 while holding the cleaner body 100 (or the connection pipe 200) using only one hand.

If, unlike the present disclosure, the stopping groove 322 and the second lever 360 are not provided, in a state in which the connection pipe 200 is separated from the suction nozzle 300, the connection neck 302 may be in a state of lying on the floor surface B. In this case, at the time of coupling the connection pipe 200 and the connection neck 302, a user is required to lay the connection pipe 200 down also, which may cause inconvenience. In addition, since the user is required to hold both the suction nozzle 300 and the connection pipe 200 and couple the suction nozzle 300 and the connection pipe 200 with each other, the user cannot couple the suction nozzle 300 and the connection pipe 200 using only one hand.

The present disclosure is directed to providing a vacuum cleaner including a suction nozzle having a first suction port, a cleaner body connected to the suction nozzle through a connection pipe, and a means capable of maintaining or releasing the fastening between the suction nozzle and the connection pipe according to the relative angle between the suction nozzle and the connection pipe.

The present disclosure is further directed to providing a vacuum cleaner having a means configured such that a reference angle is determined as a boundary between an angle range in which the vacuum cleaner is used and an angle range in which the vacuum cleaner is not used, and the fastening between a suction nozzle and a connection pipe can be automatically released if the angle between a nozzle housing and a connection neck is smaller than the reference angle.

The present disclosure is further directed to providing a vacuum cleaner having a suction nozzle including a nozzle housing and a connection neck structured such that the connection neck can freely rotate within a predetermined range of angle relative to the nozzle housing while a connection pipe remains fastened to the connection neck and, when the connection pipe is separated from the connection neck, the connection neck can be fixed at a predetermined angle with respect to the nozzle housing.

According to one aspect of the subject matter described herein, a vacuum cleaner includes: a cleaner body; a connection pipe connected to the cleaner body; and a suction nozzle coupled to the connection pipe. The cleaner body has a motor (first motor) provided therein, which is configured to rotate such that a suction force is generated.

The suction nozzle has a first catching groove. The suction nozzle includes a connection neck, a nozzle housing, a first catching body, and a first elastic body.

The connection neck has a tube shape, and is attached to or detached from the connection pipe. The connection pipe may be inserted into the connection neck.

The nozzle housing is coupled to the connection neck so as to be rotatable about a first rotation shaft. A first suction port configured to communicate with an inside of the connection pipe through the connection neck is disposed on a bottom surface of the nozzle housing.

The first catching body includes a first catching protrusion portion coupled to the connection neck and configured to catch the first catching groove. The first elastic body is configured to elastically support the first catching body such that catching between the first catching groove and the first catching protrusion portion is maintained.

According to one aspect of the subject matter described herein, the suction nozzle further includes a pressing portion and a first lever. The pressing portion is configured to contact the first lever. The pressing portion is disposed on the nozzle housing. The pressing portion may be disposed on the upper portion of the nozzle housing.

The first lever is coupled to the connection neck so as to be rotatable about a second rotation shaft parallel to the first rotation shaft. The first lever includes a first end portion and a second end portion. The first end portion is configured to contact the pressing portion. The second end portion is configured to press the first catching body such that the first catching groove and the first catching protrusion portion are released from each other. Based on a state in which the first lever starts to be pressed by the nozzle housing, the first lever may be disposed in a front part of the connection neck.

In some embodiments, the connection neck includes an inner tube and an outer tube. The inner tube has a tube shape, and an inside of the inner tube is configured to communicate with the inside of the connection pipe.

The inner tube may include a first lever bracket. The first lever bracket may be disposed on an outer surface of the inner tube, and the first lever may be rotatably coupled to the first lever bracket. The outer tube is disposed outside the inner tube.

The outer tube may include a first opening. The first opening is disposed outside the inner tube, and forms a passage through which the first catching protrusion portion moves.

The outer tube may include a skirt portion. The skirt portion is positioned outside the inner tube so as to be closer to the first rotation shaft than the first opening and a first button cover. The first lever may be positioned between the inner tube and the outer tube, and may be configured such that the first end portion protrudes out of the outer tube.

The vacuum cleaner may include a first button cover. The first button cover covers the first opening and is coupled to the outer tube outside the first catching body. The first end portion may protrude out of the skirt portion, and the second end portion may be covered by the first button cover.

The suction nozzle may include a corrugated tube. The corrugated tube has a curved tube shape, and is inserted into the nozzle housing and the inner tube.

In some embodiments, the first catching body may be coupled to the connection neck so as to be rotatable about a third rotation shaft, and the second rotation shaft may be formed closer to the first rotation shaft than the third rotation shaft. The first catching body may include a first rotation center portion and a first lift portion. The first rotation center portion has a third rotation shaft formed as a rotation shaft of the first catching body, at a position farther from the first rotation shaft than the first catching protrusion portion.

The first lift portion is disposed at a position closer to the first rotation shaft than the first catching protrusion portion, and is configured to contact the second end portion at an outside of the second end portion. The first catching body may include a first elastic body coupling portion and a first button portion. The first elastic body coupling portion has a space, in which the first elastic body is coupled, formed between the first button cover and the first elastic body coupling portion. The first button portion extends from the first rotation center portion so as to face away from the second rotation shaft and to protrude out of the first button cover while being spaced apart from the connection neck.

According to one aspect of the subject matter described herein, the length from the second rotation shaft to the first end portion is longer than the length from the second rotation shaft to the second end portion. In some embodiments, the nozzle housing includes a nozzle head portion and a nozzle neck portion.

The nozzle head portion includes the first suction port. The nozzle neck portion has a tube shape and extends rearward from the nozzle head portion. The nozzle neck portion is coupled to the connection neck so as to be rotatable about the first rotation shaft. The pressing portion is disposed on the nozzle neck portion.

The nozzle neck portion may be divided into a front portion and a rear portion. The front portion has a tube shape. The rear portion extends rearward from the front portion, and has a rear part having an open upper side.

In some embodiments, the pressing portion may be disposed at a rear end of the rear portion. The connection neck may be divided into an upper portion and a lower portion. The upper portion has a tube shape. The lower portion extends from the upper portion toward the first rotation shaft, and is rotatably coupled to the rear portion.

In a state in which the connection neck is stood upright such that the first end portion is in contact with the pressing portion, the lower portion has a shape having an open front side, and the first end portion protrudes below a front lower end of the upper portion. The corrugated tube may be inserted into the nozzle neck portion and the connection neck.

In some embodiments of the vacuum cleaner, in a state in which the connection neck is stood upright such that the first end portion is in contact with the pressing portion, the second rotation shaft may be positioned in front of the first rotation shaft.

A rotation angle θ1 of the connection pipe from a first state in which the first end portion starts to contact the pressing portion to a second state in which the connection pipe is maximally rotated in a rearward direction of the suction nozzle may be 60° or greater. A rotation angle θ2 of the connection pipe from the first state to a third state in which the connection pipe is rotated in a frontward direction of the suction nozzle to release catching between the first catching groove and the first catching protrusion portion may be ⅓ or less of θ1. The nozzle neck portion may have a concave groove shape disposed on the inner surface thereof.

According to one aspect of the subject matter described herein, the vacuum cleaner includes a second lever and a third elastic body. The second lever is rotatably coupled to the connection neck, and includes a stopping protrusion inserted into the stopping groove. The third elastic body is coupled to the connection neck and is configured to elastically support the second lever such that the stopping protrusion is inserted into the stopping groove. When the connection pipe is inserted into the connection neck, the connection pipe presses the second lever such that the stopping protrusion is separated from the stopping groove.

In some embodiments, the suction nozzle and the connection pipe are coupled to each other so as to be rotatable about a first rotation shaft, and the suction nozzle includes a pressing portion and a first lever. If the first lever is rotated by the pressing portion, the first lever presses the first catching body such that the first catching groove and the first catching release portion are released from each other. In addition, in a range of angle between the suction nozzle and the connection pipe during use of the vacuum cleaner (for example, if the angle between the suction nozzle and the connection pipe is in a range of 90-180°), the pressing portion and the first lever may make no contact. In a range of angle between the suction nozzle and the connection pipe during storage of the vacuum cleaner (for example, an angle of 90° or less between the suction nozzle and the connection pipe), the pressing portion may press the first lever. This guarantees that, according to the relative angle between the suction nozzle and the connection pipe, fastening between the suction nozzle and the connection pipe may be maintained or released. This also enables the user to separate the connection pipe from the suction nozzle simply by tilting the connection pipe relative to the suction nozzle while holding the connection pipe with one hand.

In some embodiments, based on a state (first state) in which the first lever starts to be pressed by the pressing portion of the nozzle housing, the first lever is coupled to the front portion of the connection neck. In addition, the first rotation shaft is disposed below the second rotation shaft. In the first state, if the connection pipe rotates toward the rear side of the suction nozzle, the first lever and the pressing portion do not come into contact, and the vacuum cleaner can be freely used without separation between the suction nozzle and the connection pipe. In addition, in the first state, by rotating the connection pipe forward relative to the suction nozzle (rotating the connection pipe such that the angle between the nozzle housing and the connection neck becomes equal to or smaller than a reference angle), the connection pipe can be simply separated from the suction nozzle.

In some embodiments, the suction nozzle includes a connection neck, a nozzle housing (including a nozzle head portion and a nozzle neck portion), a second lever, and a third elastic body. The nozzle neck portion is coupled to the connection neck so as to be rotatable about a first rotation shaft. The nozzle neck portion has a stopping groove disposed on the inner surface thereof. The second lever includes a stopping protrusion inserted into the stopping groove and caught therein. When the first connection portion of the connection pipe is inserted into the connection neck, the first connection portion presses the second lever such that the stopping protrusion is released from the stopping groove. If the connection pipe is separated from the connection neck, the stopping protrusion may be inserted into the stopping groove. Accordingly, the connection neck may freely rotate within a predetermined range of angle relative to the nozzle housing while the connection pipe is fastened to the connection neck, and the connection neck may be fixed at a predetermined angle relative to the nozzle housing if the connection pipe is separated from the connection neck.

Particularly, if the connection pipe is separated from the connection neck, the connection neck may remain upright relative to the floor (for example, the axial direction of the connection neck is perpendicular to the floor or at an angle or 45° or higher) instead of lying on the floor, thereby facilitating recoupling between the connection pipe and the connection neck.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a cleaner body including a body suction port;

a connection pipe coupled to the body suction port; and a suction nozzle configured to be selectively coupled to or separated from an end of the connection pipe, wherein:

the connection pipe includes a catching groove, the suction nozzle includes:

a connection neck that is selectively coupled to or separated from the end of the connection pipe; and a first latch coupled to the connection neck and including a catching protrusion which engages the catching groove when the connection neck is coupled to the end of the connection pipe, and as the connection neck is rotated at a particular angle with respect to a floor surface, the first latch moves such that the connection pipe and the connection neck are separable from each other, wherein the suction nozzle further includes:

a nozzle housing coupled to the connection neck having a tube shape so as to be rotatable about a first rotation shaft, wherein a first suction port configured to communicate with an inside of the connection pipe throe the neck is provided on a bottom surface of the nozzle housing;

a first spring configured to elastically support the first latch such that engagement between the catching groove and the catching protrusion is maintained;

a pressing surface provided on the nozzle housing; and a first lever coupled to the connection neck so as to be rotatable about a second rotation shaft parallel to the first rotation shaft, and including a first end configured to contact the pressing surface and a second end configured to press the first latch such that the catching groove and the catching protrusion are released from each other.

2. The vacuum cleaner of claim 1, wherein the connection neck includes:

an inner tube having a tube shape, wherein an inside of the inner tube is configured to communicate with the inside of the connection pipe; and an outer tube positioned outside the inner tube, and wherein the first lever is positioned between the inner tube and the outer tube, and the first end protrudes out of the outer tube.

3. The vacuum cleaner of claim 1, wherein:

the connection neck includes:

an inner tube having a tube shape, wherein an inside of the inner tube is configured to communicate with the inside of the connection pipe, and wherein a first lever bracket to which the first lever is rotatably coupled is provided at an outer surface of the inner tube;

an outer tube including a first opening provided outside the inner tube, wherein the first opening forms a passage through which the catching protrusion moves; and a first button cover configured to cover the first opening, the first button cover being coupled to the outer tube at an outside of the first latch, the outer tube includes a skirt region positioned outside the inner tube so as to be closer to the first rotation shaft than the first opening and the first button cover, and the first end protrudes out of the skirt region and the second end is covered by the first button cover.

4. The vacuum cleaner of claim 1, wherein the connection neck includes:

an inner tube having a tube shape, wherein an inside of the inner tube is configured to communicate with the inside of the connection pipe; and an outer tube positioned outside the inner tube, the suction nozzle includes a corrugated tube configured to be bendable into a curved tube shape, wherein the corrugated tube is inserted into the nozzle housing and the inner tube, and the first lever is positioned between the inner tube and the outer tube.

5. The vacuum cleaner of claim 1, wherein:

the first latch is coupled to the connection neck so as to be rotatable about a third rotation shaft, and the second rotation shaft is closer to the first rotation shaft than the third rotation shaft.

6. The vacuum cleaner of claim 1, wherein the first latch includes:

a first rotation center portion having a third rotation shaft formed as a rotation shaft of the first latch, at a position farther from the first rotation shaft than the catching protrusion; and a first lift portion positioned closer to the first rotation shaft than the catching protrusion, and configured to contact an outside of the second end.

7. The vacuum cleaner of claim 6, wherein:

the connection neck includes:

an outer tube includes a first opening, the first opening forming a passage through which the catching protrusion moves; and a first button cover positioned outside the catching protrusion and coupled to the outer tube, and the first latch includes:

a first spring coupling region having a space, in which the first spring is coupled, formed between the first button cover and the first spring coupling region; and a first button portion extending from the first rotation center portion so as to face away from the second rotation shaft and to protrude out of the first button cover while being spaced apart from the connection neck.

8. The vacuum cleaner of claim 1, wherein a length from the second rotation shaft to the first end is greater than a length from the second rotation shaft to the second end.

9. The vacuum cleaner of claim 1, wherein the nozzle housing includes:

a nozzle head including the first suction port; and a nozzle neck having a tube shape and extending rearward from the nozzle head, wherein the nozzle neck is coupled to the connection neck so as to be rotatable about the first rotation shaft, and wherein the pressing surface is provided at the nozzle neck.

10. The vacuum cleaner of claim 9, wherein the nozzle neck includes:

a front portion having a tube shape; and a rear portion extending rearward from the front portion and having a rear part with an open upper side, wherein the pressing surface is provided at an upper rear end of the rear portion.

11. The vacuum cleaner of claim 10, wherein:

the connection neck includes:

an upper portion having a tube shape; and a lower portion extending from the upper portion toward the first rotation shaft, the lower portion being rotatably coupled to the rear portion of the nozzle neck, and when the connection neck is positioned to extend upright such that the first end is in contact with the pressing surface, the lower portion of the connection neck has a shape having an open front side, and the first end protrudes below a front lower end of the upper portion of the connection neck.

12. The vacuum cleaner of claim 9, wherein the suction nozzle includes a corrugated tube configured to be bendable into a curved tube shape, wherein the corrugated tube is inserted into the nozzle neck portion and the connection neck.

13. The vacuum cleaner of claim 1, wherein, when the connection neck is positioned such that the first end is in contact with the pressing surface, the second rotation shaft is positioned in front of the first rotation shaft.

14. The vacuum cleaner of claim 1, wherein a rotation angle θ1 of the connection pipe from a first state in which the first end starts to contact the pressing surface to a second state in which the connection pipe is maximally rotated in a rearward direction of the suction nozzle is 60° or greater, and a rotation angle θ2 of the connection pipe from the first state to a third state in which the connection pipe is rotated in a frontward direction of the suction nozzle to release catching between the catching groove and the catching protrusion is ⅓ or less of the rotational angle θ1.

15. The vacuum cleaner of claim 1, wherein the suction nozzle includes:

the connection neck into which the connection pipe is inserted;

a nozzle head including the first suction port;

a nozzle neck having a tube shape and extending rearward from the nozzle head, wherein the nozzle neck is coupled to the connection neck so as to be rotatable about the first rotation shaft, and wherein a stopping groove is provided at an inner surface of the nozzle neck portion;

a second lever rotatably coupled to the connection neck and having a stopping protrusion configured to be selectively inserted into the stopping groove; and a third spring coupled to the connection neck and configured to elastically support the second lever such that the stopping protrusion is inserted into the stopping groove, wherein when the connection pipe is inserted into the connection neck, the connection pipe is configured to press the second lever such that the stopping protrusion is separated from the stopping groove.

16. The vacuum cleaner of claim 1, wherein the first latch rotates such that the connection pipe and the connection neck are separable from each other when the connection neck is rotated perpendicularly with respect to a floor surface.

17. A vacuum cleaner comprising:

a cleaner body;

a connection pipe connected to the cleaner body and having a catching groove; and a suction nozzle including:

a connection neck that is selectively attached to or detached from the connection pipe;

a nozzle housing coupled to the connection neck so as to be rotatable about a first rotation shaft, wherein a suction port configured to communicate with an inside of the connection pipe through the connection neck is provided on a bottom surface of the nozzle housing; and a first latch coupled to the connection neck and including a catching protrusion which is selectively received by the catching groove, wherein the suction nozzle further includes a lever coupled to the connection neck so as to be rotatable about a second rotation shaft, and when the lever is pressed by the nozzle housing and rotated about the second rotation shaft, the lever is configured to move the catching protrusion such that the catching protrusion is released from the catching groove.

18. The vacuum cleaner of claim 17, wherein the first rotation shaft and the second rotation shaft extend parallel to each other.

19. The vacuum cleaner of claim 18, wherein the first rotation shaft extends along a horizontal direction, a rotation angle θ1 of the connection pipe from a first state in which the lever starts to be pressed by the nozzle housing to a second state in which the connection pipe is maximally rotated in a rear direction of the suction nozzle is 60° or greater, and a rotation angle θ2 of the connection pipe from the first state to a third state in which the connection pipe is rotated in a frontward direction of the suction nozzle to release catching between the catching groove and the catching protrusion is ⅓ or less of the rotation angle θ1.

20. The vacuum cleaner of claim 18, wherein:

the first rotation shaft extends along a horizontal direction, a pressing surface in contact with the lever is provided in an upper part of the nozzle housing, and when the lever contacts the nozzle housing, the lever is provided in front of the connection neck.

* * * * *